US009220950B2

(12) United States Patent
Comeau et al.

(10) Patent No.: US 9,220,950 B2
(45) Date of Patent: Dec. 29, 2015

(54) NEGATIVE HARDNESS GRADIENT CORES MADE OF POLYALKENAMER RUBBER FOR GOLF BALLS

(71) Applicant: Acushnet Company, Fairhaven, MA (US)

(72) Inventors: Brian Comeau, Berkley, MA (US); David A. Bulpett, Boston, MA (US); Michael J. Sullivan, Old Lyme, CT (US); Robert Blink, Newport, RI (US); Douglas S. Goguen, New Bedford, MA (US); Mark L. Binette, Mattapoisett, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 14/471,365

(22) Filed: Aug. 28, 2014

(65) Prior Publication Data

US 2014/0371005 A1 Dec. 18, 2014

Related U.S. Application Data

(60) Division of application No. 12/855,388, filed on Aug. 12, 2010, now Pat. No. 8,821,316, which is a continuation of application No. 12/186,877, filed on Aug. 6, 2008, now Pat. No. 7,803,069, which is a continuation of application No. 11/832,197, filed on Aug. 1, 2007, now Pat. No. 7,410,429, which is a continuation-in-part of application No. 11/829,461, filed on Jul. 27, 2007, now Pat. No. 7,537,530, which is a continuation-in-part of application No. 11/772,903, filed on Jul. 3, 2007, now Pat. No. 7,537,529.

(51) Int. Cl.

| | |
|---|---|
| ***A63B 37/02*** | (2006.01) |
| ***A63B 37/04*** | (2006.01) |
| ***A63B 37/00*** | (2006.01) |
| ***A63B 37/12*** | (2006.01) |

(52) U.S. Cl.

CPC ..... *A63B 37/0075* (2013.01); *A63B 37/0003* (2013.01); *A63B 37/0039* (2013.01); *A63B 37/0044* (2013.01); *A63B 37/0045* (2013.01); *A63B 37/0051* (2013.01); *A63B 37/0062* (2013.01); *A63B 37/0063* (2013.01); *A63B 37/0064* (2013.01); *A63B 37/12* (2013.01)

(58) Field of Classification Search

CPC ..... A63B 37/0003; A63B 37/0063

See application file for complete search history.

(56) References Cited

U.S. PATENT DOCUMENTS

| | | | |
|---|---|---|---|
| 3,492,245 | A | 1/1970 | Calderon et al. |
| 3,784,209 | A | 1/1974 | Berman |

(Continued)

OTHER PUBLICATIONS

Evonik Industries; Vestenamer 8012 Rubber With Unique Properties; Mar. 2009.

*Primary Examiner* — John E Simms, Jr.

(74) *Attorney, Agent, or Firm* — Daniel W. Sullivan

(57) ABSTRACT

Golf balls having cores with negative hardness gradients are provided. The cores are made of polyalkenamer rubber compositions that may further include other rubbers such as, for example, polybutadiene, polyisoprene, ethylene propylene rubber, ethylene propylene diene rubber, and styrene-butadiene rubber. In one version, a solid, single core having an outer surface and center is provided, wherein the outer surface has a hardness substantially the same or lower than the hardness of the center to define a zero or negative hardness gradient. Dual-cores having inner and outer cores can be made, wherein the inner core has a negative hardness gradient and the outer core has a positive or negative hardness gradient. The rubber composition helps improve resiliency of the core and provides the ball with a comfortable and soft feel.

15 Claims, 6 Drawing Sheets

(56) References Cited

U.S. PATENT DOCUMENTS

| | | | | |
|---|---|---|---|---|
| 3,804,803 | A | 4/1974 | Streck | |
| 3,986,802 | A | 10/1976 | Isom | |
| 4,183,876 | A | 1/1980 | Coran et al. | |
| 4,570,937 | A | 2/1986 | Yamada | |
| 4,650,193 | A | 3/1987 | Molitor et al. | |
| 4,792,141 | A | 12/1988 | Llort | |
| 4,840,993 | A | 6/1989 | Bartz | |
| 5,033,748 | A * | 7/1991 | Ebisuno | A63B 37/0003 473/371 |
| 5,334,673 | A | 8/1994 | Wu | |
| 5,460,367 | A | 10/1995 | Horiuchi | |
| 5,484,870 | A | 1/1996 | Wu | |
| 5,516,110 | A | 5/1996 | Yabuki et al. | |
| 5,697,856 | A | 12/1997 | Moriyama et al. | |
| 5,730,664 | A | 3/1998 | Asakura et al. | |
| 5,733,206 | A | 3/1998 | Nesbitt et al. | |
| 5,779,562 | A | 7/1998 | Melvin et al. | |
| 5,782,707 | A | 7/1998 | Yamagishi et al. | |
| 5,803,834 | A | 9/1998 | Yamagishi et al. | |
| 5,957,784 | A | 9/1999 | Asakura et al. | |
| 5,976,443 | A | 11/1999 | Nesbitt et al. | |
| 6,113,831 | A | 9/2000 | Nesbitt et al. | |
| 6,319,154 | B1 | 11/2001 | Yoshida et al. | |
| 6,432,342 | B1 | 8/2002 | Nesbitt et al. | |
| 6,494,793 | B1 | 12/2002 | Ohama | |
| 6,494,794 | B1 | 12/2002 | Ohama | |
| 6,506,851 | B2 | 1/2003 | Wu | |
| 6,533,683 | B2 | 3/2003 | Watanabe | |
| 6,537,158 | B2 | 3/2003 | Watanabe | |
| 6,632,147 | B2 | 10/2003 | Cavallaro et al. | |
| 6,659,888 | B2 | 12/2003 | Endo et al. | |
| 6,679,791 | B2 | 1/2004 | Watanabe | |
| 6,689,860 | B2 | 2/2004 | Iwami | |
| 6,739,986 | B2 | 5/2004 | Higuchi et al. | |
| 6,767,940 | B2 | 7/2004 | Voorheis et al. | |
| 6,783,468 | B2 | 8/2004 | Sullivan et al. | |
| 6,805,644 | B1 | 10/2004 | Moriyama et al. | |
| 6,815,521 | B2 | 11/2004 | Iwami | |
| 6,835,794 | B2 | 12/2004 | Wu et al. | |
| 6,837,803 | B2 * | 1/2005 | Nanba | A63B 37/0003 473/351 |
| 6,921,345 | B2 | 7/2005 | Higuchi et al. | |
| 6,932,720 | B2 | 8/2005 | Hogge et al. | |
| 7,041,009 | B2 | 5/2006 | Sullivan et al. | |
| 7,044,864 | B2 | 5/2006 | Sullivan et al. | |
| 7,118,495 | B2 | 10/2006 | Sullivan et al. | |
| 7,125,345 | B2 | 10/2006 | Sullivan et al. | |
| 7,153,224 | B2 * | 12/2006 | Higuchi | A63B 37/0003 473/376 |
| 7,528,196 | B2 | 5/2009 | Kim et al. | |
| 2003/0078115 | A1 | 4/2003 | Kennedy et al. | |
| 2003/0236135 | A1 | 12/2003 | Hogge et al. | |
| 2004/0082407 | A1 | 4/2004 | Sullivan et al. | |
| 2005/0176523 | A1 | 8/2005 | Boehm et al. | |
| 2006/0166762 | A1 * | 7/2006 | Kim | A63B 37/0003 473/374 |
| 2008/0161133 | A1 * | 7/2008 | Sullivan | A63B 37/0003 473/376 |
| 2009/0191981 | A1 | 7/2009 | Kim et al. | |
| 2013/0012338 | A1 | 1/2013 | Snell | |

* cited by examiner

NEGATIVE HARDNESS GRADIENT CORES MADE OF POLYALKENAMER RUBBER FOR GOLF BALLS

CROSS-REFERENCE TO RELATED APPLICATIONS

This application is a divisional of co-pending, co-assigned U.S. patent application Ser. No. 12/855,388 having a filing date of Aug. 12, 2010, now allowed, which is a continuation-in-part of co-pending, co-assigned U.S. patent application Ser. No. 12/186,877 having a filing date of Aug. 6, 2008, now U.S. Pat. No. 7,803,069, which is a continuation of U.S. patent application Ser. No. 11/832,197 having a filing date of Aug. 1, 2007, now U.S. Pat. No. 7,410,429, which is a continuation-in-part of U.S. patent application Ser. No. 11/829,461 having a filing date of Jul. 27, 2007, now U.S. Pat. No. 7,537,530, which is a continuation-in-part of U.S. patent application Ser. No. 11/772,903 having a filing date of Jul. 3, 2007, now U.S. Pat. No. 7,537,529, the entire disclosures of which are hereby incorporated by reference.

BACKGROUND OF THE INVENTION

1. Field of the Invention

This invention relates generally to golf balls with cores, for example, single-layer cores having a surface hardness equal to or less than the center hardness, that is a negative hardness gradient. The invention also includes golf balls containing dual-cores having an inner core and outer core layer. In one version, each of the inner and outer core layers has a negative hardness gradient. In another version, the inner core layer has a negative hardness gradient and the outer core layer has a positive hardness gradient. Preferably, the cores are made of a rubber composition comprising cycloalkene (polyalkenamer) rubber and more preferably polyoctenamer rubber.

2. Brief Review of the Related Art

Solid golf balls are typically made with a solid core encased by a cover, both of which can have multiple layers, such as a dual-core having a solid center and an outer core layer, or a multi-layer cover having an inner. Generally, golf ball cores and/or centers are constructed with a thermoset rubber, typically a polybutadiene-based composition. The cores are usually heated and cross-linked to create certain characteristics, such as higher or lower compression, which can impact the spin rate of the ball and/or provide better "feel." These and other characteristics can be tailored to the needs of golfers of different abilities. From the perspective of a golf ball manufacturer, it is desirable to have cores exhibiting a wide range of properties, such as resilience, durability, spin, and "feel," because this enables the manufacturer to make and sell many different types of golf balls suited to differing levels of ability.

Heretofore, most single core golf ball cores have had a conventional hard-to-soft hardness gradient from the surface of the core to the center of the core, otherwise known as a "positive hardness gradient." The patent literature contains a number of references that discuss a hard surface to soft center hardness gradient across a golf ball core.

U.S. Pat. No. 4,650,193 to Molitor et al. generally discloses a hardness gradient in the surface layers of a core by surface treating a slug of curable elastomer with a cure-altering agent and subsequently molding the slug into a core. This treatment allegedly creates a core with two zones of different compositions, the first part being the hard, resilient, central portion of the core, which was left untreated, and the second being the soft, deformable, outer layer of the core, which was treated by the cure-altering agent. The two "layers" or regions of the core are integral with one another and, as a result, achieve the effect of a gradient of soft surface to hard center.

U.S. Pat. No. 3,784,209 to Berman, et al. generally discloses a soft-to-hard hardness gradient. The '209 patent discloses a non-homogenous, molded golf ball with a core of "mixed" elastomers. A center sphere of uncured elastomeric material is surrounded by a compatible but different uncured elastomer. When both layers of elastomer are concurrently exposed to a curing agent, they become integral with one another, thereby forming a mixed core. The center of this core, having a higher concentration of the first elastomeric material, is harder than the outer layer. One drawback to this method of manufacture is the time-consuming process of creating first elastomer and then a second elastomer and then molding the two together.

Other patents discuss cores that receive a surface treatment to provide a soft "skin." However, since the interior portions of these cores are untreated, they have the similar hard surface to soft center gradient as conventional cores. For example, U.S. Pat. No. 6,113,831 to Nesbitt et al. generally discloses a conventional core and a separate soft skin wrapped around the core. This soft skin is created by exposing the preform slug to steam during the molding process so that a maximum mold temperature exceeds a steam set point, and by controlling exothermic molding temperatures during molding. The skin comprises the radially-outermost 1/32 inch to 1/4 inch of the spherical core. U.S. Pat. Nos. 5,976,443 and 5,733,206, both to Nesbitt et al., disclose the addition of water mist to the outside surface of the slug before molding in order to create a soft skin. The water allegedly softens the compression of the core by retarding crosslinking on the core surface, thereby creating an even softer soft skin around the hard central portion.

Additionally, a number of patents disclose multilayer golf ball cores, where each core layer has a different hardness thereby creating a hardness gradient from core layer to core layer. There remains a need, however, to achieve a single layer core that has a soft-to-hard gradient (a "negative" gradient), from the surface to the center, and to achieve a method of producing such a core that is inexpensive and efficient. A core exhibiting such characteristics would allow the golf ball designer to create products with unique combinations of compression, "feel," and spin.

Today, multi-piece solid golf balls are popular for several reasons including new manufacturing methods, availability and cost of raw materials, and playing performance properties of such balls. For example, three-piece solid golf balls having an inner core and outer cover with an intermediate layer disposed there between are commonly used by both professional and recreational golfers. In conventional multi-piece golf balls, the inner core is made commonly of a rubber material such as styrene butadiene, polybutadiene, poly(cis-isoprene), poly(trans-isoprene), or highly neutralized acid copolymers. Often, the intermediate layer is made of an olefin-based ionomer resin that imparts some hardness to the ball. These ionomer acid copolymers contain inter-chain ionic bonding and are generally made of an α-olefin such as ethylene and a vinyl comonomer having an acid group such as methacrylic, acrylic acid, or maleic acid. Metal ions such as sodium, lithium, zinc, and magnesium are used to neutralize the acid groups in the copolymer. In recent years, there has been interest in using thermoplastic and thermosetting polyurethanes, polyureas, and hybrid compositions for the outer cover. The golf ball industry is looking to develop multi-piece balls having high resiliency as well as a soft feel. Balls having a high resiliency tend to reach a high velocity when struck by a golf club. As a result, the ball tends to travel a greater distance which is particularly important for driver shots off the tee. Meanwhile, the soft feel of the ball provides the player with a more enjoyable sensation when he/she strikes the ball with the club. The player senses a more natural feeling and control over the ball as the club face makes impact.

In turn, manufacturers of golf balls are looking at a wide variety of compositions for making multi-piece golf balls. For example, Kim et al., U.S. Pat. No. 7,528,196 and U.S. Patent Application Publication US 2009/0191981 disclose a golf ball comprising a core, cover layer, and optionally one or more inner cover layers, wherein at least one portion of the ball comprises a blend of a polyalkenamer and polyamide. The polyalkenamer/polyamide composition contains about 2 to about 90 weight % of a polyalkenamer polymer and about 10 to about 98 weight % of a polyamide. The '196 patent and '981 Published application further disclose that the polyalkenamer/polyamide composition may be blended with other polymers including polybutadiene, polyisoprene, polychloroprene, polybutylene, and styrene-butadiene rubber prior to molding. However, neither the '196 patent nor '981 Published application discloses a dual-core having an inner core and surrounding outer core layer, wherein the inner core has a zero or negative hardness gradient, and the outer core layer has a zero; negative; or positive hardness gradient and the inner core and/or outer core is made of a polyalkenamer rubber composition.

In Voorheis et al., U.S. Pat. No. 6,767,940, a golf ball having a core, an intermediate layer, and a cover is disclosed. The core is formed from a composition containing an elastomeric polymer, free-radical initiator, and at least one stable free-radical. The stable free-radical increases the scorch time (time between start of reaction and onset of cross-linking) of the elastomeric polymer. The '940 patent discloses numerous materials that can be used to form the intermediate layer, which is distinguishable from the core, including natural rubbers; balata; gutta-percha; cis-polybutadienes; trans-polybutadienes; synthetic polyisoprenes; polyoctenamers; polypropylene resins; ionomer resins; polyamides; polyesters; urethanes; polyureas; chlorinated polyethylenes; polysulfide rubbers; and fluorocarbons.

In Sullivan et al., U.S. Pat. Nos. 6,783,468, 7,041,009, 7,044,864, 7,118,495, and 7,125,345, a golf ball having a low compression and high coefficient of restitution (COR) layer supported and reinforced by a low deformation layer is disclosed. The preferred polymeric composition for the high COR layer is a base rubber compound, a co-reaction agent, a halogenated organosulfur compound, and a co-crosslinking or initiator agent. The low deformation layer may be made of rigid plastics or polymers reinforced with high strength organic or inorganic fillers or fibers. In one embodiment, the golf ball comprises an innermost core, an outer core, and a cover. The inner core comprises a low deformation material and the outer core comprises a rubber composition. The patents disclose that natural rubbers, including cis-polyisoprene, trans-polyisoprene or balata, synthetic rubbers including 1,2-polybutadiene, cis-polybutadiene, trans-polybutadiene, polychloroprene, poly(norbornene), polyoctenamer and polypentenamer may be used for the outer core. However, there is no disclosure of forming a dual core, wherein the inner core has a positive hardness gradient and the outer core layer has a zero; negative; or positive hardness gradient, and the inner core and/or outer core is made of a polyalkenamer rubber composition.

In addition, Llort, U.S. Pat. No. 4,792,141 describes a balata-covered golf ball, where up to 40% of the balata used to form the cover has been replaced with polyoctenylene rubber. The golf ball contains a core and a cover wherein the cover is formed from a composition comprising about 97 to about 60 parts balata and about 3 to about 40 parts by weight polyoctenylene rubber based on 100 parts by weight polymer in the composition. The '141 patent discloses that using more than about 40 parts by weight of polyoctenylene produces deleterious effects.

One objective of the present invention is to develop compositions that can be used to make a core for a golf ball, wherein the core provides the ball with high resiliency along with a comfortable and soft "feel." The present invention provides golf ball core compositions having such properties as well as other advantageous characteristics, features, and benefits.

SUMMARY OF THE INVENTION

The invention provides golf balls containing dual-cores having an inner core and outer core layer. In one version, each of the inner and outer core layers has a negative hardness gradient. In another version, the inner core layer has a negative hardness gradient and the outer core layer has a positive hardness gradient. In a particularly preferred embodiment, the golf ball contains a solid, single core made of a rubber composition comprising a cycloalkene (polyalkenamer) rubber, for example, polyoctenamer, having a trans-content of 55% or greater and a melting point of 30° C. or greater in an amount of at least 50 weight percent. The concentration of rubber is preferably in the range of about 60 to about 100 weight percent based on weight of polymer. The rubber composition may further include other rubbers such as, for example, polybutadiene, polyisoprene, ethylene propylene rubber, ethylene propylene diene rubber, and styrene-butadiene rubber. The rubber composition helps improve resiliency of the core and provides the ball with a comfortable, soft feel. The core has an outer surface and geometric center is provided, wherein the outer surface has a hardness substantially the same or lower than the hardness of the geometric center to define a zero or negative hardness gradient. In one embodiment, a cover layer surrounds the core. The cover may be mult-layered comprising an inner and outer cover layer. In a second version, a dual-core having an inner core and surrounding outer core layer is provided. The inner core may be made of a polyalkenamer rubber composition and have a negative hardness gradient. The outer core layer has a second outer surface and an inner surface and also may be made of a polyalkenamer rubber composition. In one example, the hardness of the second outer surface is substantially the same or less than the hardness of the inner surface to define a zero or second negative hardness gradient. In another example, the hardness of the second outer surface is greater than the hardness of the inner surface to define a positive hardness gradient.

BRIEF DESCRIPTION OF THE DRAWINGS

The novel features that are characteristic of the present invention are set forth in the appended claims. However, the preferred embodiments of the invention, together with further objects and attendant advantages, are best understood by reference to the following detailed description in connection with the accompanying drawings in which:

DETAILED DESCRIPTION OF THE INVENTION

Figure 1:
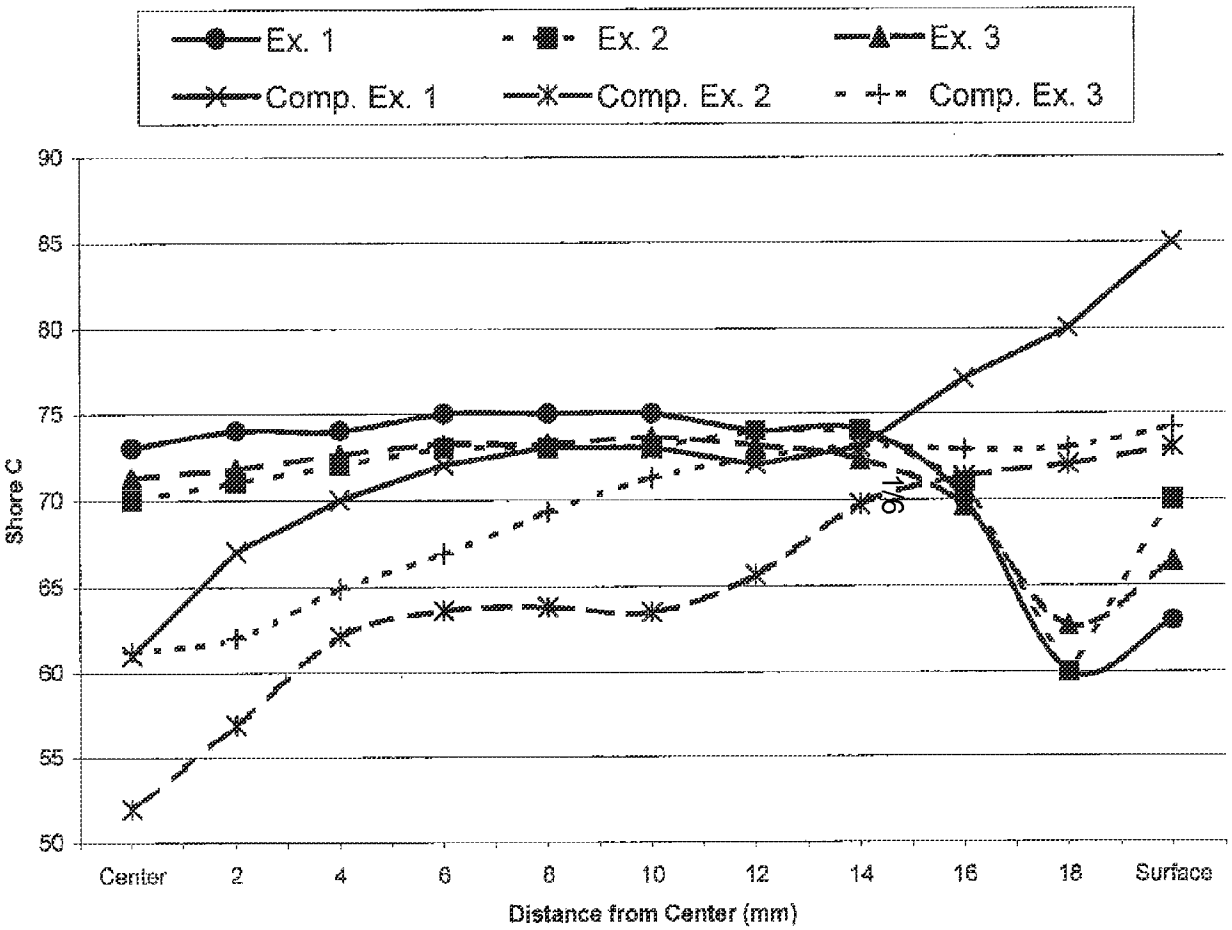
FIG. 1 is a graph of the hardness of the core as a function of the distance from its center for both inventive cores and comparative example cores.

The golf balls of the present invention may include a single-layer (one-piece) golf ball, and multi-layer golf balls, such as one having a core and a cover surrounding the core. In one preferred embodiment, the golf ball is formed from a core comprised of a solid center (otherwise known as an inner core) and an outer core layer, an inner cover layer and an outer cover layer. Of course, any of the core and/or the cover layers may include more than one layer. The term, "layer" as used herein means generally any spherical portion of the golf ball. More particularly, in one version, a two-piece ball having a solid center (otherwise referred to as an inner core) and a single-layered cover is made. In another version, a three-piece ball having an inner core and a multi-layered cover (with an inner cover layer and outer cover layer) is made. In another version, a four-piece golf ball comprising a dual-core having an inner core and a surrounding outer core layer and a multi-layered cover is made. In yet another construction, a five-piece golf ball having a dual-core, intermediate layer, and multi-layered cover is made. The diameter and thickness of the different layers along with properties such as hardness and compression may vary depending upon the construction and desired playing performance properties of the golf ball. The core may contain sections having substantially the same hardness or different hardness levels. That is, there can be substantially uniform hardness throughout the different sections or there can be hardness gradients as discussed in further detail below.

In one preferred embodiment, the core is formed of an inner core and an outer core layer where both the inner core and the outer core layer have a "soft-to-hard" hardness gradient (a "negative" hardness gradient) radially inward from each component's outer surface towards its innermost portion (i.e., the center of the inner core or the inner surface of the outer core layer), although alternative embodiments involving varying direction and combination of hardness gradient amongst core components are also envisioned (e.g., a "negative" gradient in the center coupled with a "positive" gradient in the outer core layer, or vice versa). In another preferred embodiment, the core is a solid, single-layered core having a "negative" hardness gradient (that is, the outer surface of the core is softer than its geometric center.)

Other embodiments of golf balls having various combinations of positive, negative, and zero hardness gradients may be made in accordance with this invention. For example, the inner core may have a zero or negative hardness gradient (that is, the hardness values of the outer surface of the inner core layer and the geometric center of the inner core are substantially the same) and the outer core layer may have a positive hardness gradient. Particularly, the term, "zero hardness gradient" as used herein, means a surface to center Shore C hardness gradient of less than 8, preferably less than 5 and most preferably less than 3 and may be zero or negative 1 to negative 25. The term, "negative hardness gradient" as used herein, means a surface to center Shore C hardness gradient of less than zero. The terms, "zero hardness gradient" and "negative hardness gradient" may be used herein interchangeably to refer to hardness gradients of negative 1 to negative 25. The term, "positive hardness gradient" as used herein, means a surface to center Shore C hardness gradient of 8 or greater, preferably 10 or greater, and most preferably 20 or greater. By the term, "steep positive hardness gradient" as used herein, it is meant surface to center Shore C hardness gradient of 20 or greater, more preferably 25 or greater, and most preferably 30 or greater. For example, the core may have a step positive hardness gradient of 35, 40, or 45 Shore C or greater. Methods for measuring the hardness of the inner core and surrounding layers and determining the hardness gradients are discussed in further detail below.

The center of the core may also be a liquid-filled or hollow sphere surrounded by one or more intermediate and/or cover layers, or it may include a solid or liquid center around which tensioned elastomeric material is wound. Any layers disposed around these alternative centers may exhibit the inventive core hardness gradient (i.e., "negative"). The cover layer may be a single layer or, for example, formed of a plurality of layers, such as an inner cover layer and an outer cover layer.

As briefly discussed above, the inventive cores may have a hardness gradient defined by hardness measurements made at the surface of the inner core (or outer core layer) and radially inward towards the center of the inner core, typically at 2-mm increments. As used herein, the terms "negative" and "positive" refer to the result of subtracting the hardness value at the innermost portion of the component being measured (e.g., the center of a solid core or an inner core in a dual-core construction; the inner surface of a core layer; etc.) from the hardness value at the outer surface of the component being measured (e.g., the outer surface of a solid core; the outer surface of an inner core in a dual-core; the outer surface of an outer core layer in a dual-core, etc.). For example, if the outer surface of a solid core has a lower hardness value than the center (i.e., the surface is softer than the center), the hardness gradient will be deemed a "negative" gradient (a smaller number−a larger number=a negative number). In one embodiment, it is preferred that the inventive cores have a zero or a negative hardness gradient, more preferably between zero (0) and −10, most preferably between 0 and −5.

Preferably, in one embodiment, the core layers (inner core or outer core layer) are made from a composition including at least one thermoset base rubber, such as a polybutadiene rubber, cured with at least one peroxide and at least one reactive co-agent, which can be a metal salt of an unsaturated carboxylic acid, such as acrylic acid or methacrylic acid, a non-metallic co-agent, or mixtures thereof. Preferably, a suitable antioxidant is included in the composition. An optional soft and fast agent (and sometimes a cis-to-trans catalyst), such as an organosulfur or metal-containing organosulfur compound, can also be included in the core formulation. Other ingredients that are known to those skilled in the art may be used, and are understood to include, but not be limited to, density-adjusting fillers, process aides, plasticizers, blowing or foaming agents, sulfur accelerators, and/or non-peroxide radical sources.

The base thermoset rubber, which can be blended with other rubbers and polymers, typically includes a natural or synthetic rubber. A preferred base rubber is 1,4-polybutadiene having a cis structure of at least 40%, preferably greater than 80%, and more preferably greater than 90%. Examples of desirable polybutadiene rubbers include BUNA® CB22 and BUNA® CB23, commercially available from LANXESS Corporation; UBEPOL® 360L and UBEPOL® 150L and UBEPOL-BR rubbers, commercially available from UBE Industries, Ltd. of Tokyo, Japan; KINEX® 7245 and KINEX® 7265, commercially available from Goodyear of Akron, Ohio; SE BR-1220, and TAKTENE® 1203G1, 220, and 221, commercially available from Dow Chemical Company; Europrene® NEOCIS® BR 40 and BR 60, commercially available from Polimeri Europa; and BR 01, BR 730, BR 735, BR 11, and BR 51, commercially available from Japan Synthetic Rubber Co., Ltd; PETROFLEX® BRNd-40; and KARBOCHEM® ND40, ND45, and ND60, commercially available from Karbochem.

The base rubber may also comprise high or medium Mooney viscosity rubber, or blends thereof. A "Mooney" unit is a unit used to measure the plasticity of raw or unvulcanized rubber. The plasticity in a "Mooney" unit is equal to the torque, measured on an arbitrary scale, on a disk in a vessel that contains rubber at a temperature of 100° C. and rotates at two revolutions per minute. The measurement of Mooney viscosity is defined according to ASTM D-1646. The Mooney viscosity range is preferably greater than about 40, more preferably in the range from about 40 to about 80 and more preferably in the range from about 40 to about 60. Polybutadiene rubber with higher Mooney viscosity may also be used, so long as the viscosity of the polybutadiene does not reach a level where the high viscosity polybutadiene clogs or otherwise adversely interferes with the manufacturing machinery. It is contemplated that polybutadiene with viscosity less than 65 Mooney can be used with the present invention.

In one embodiment of the present invention, golf ball cores made with mid- to high-Mooney viscosity polybutadiene material exhibit increased resiliency (and, therefore, distance) without increasing the hardness of the ball. Such cores are soft, i.e., compression less than about 60 and more specifically in the range of about 50-55. Cores with compression in the range of from about 30 about 50 are also within the range of this preferred embodiment. Commercial sources of suitable mid- to high-Mooney viscosity polybutadiene include Bayer AG CB23 (Nd-catalyzed), which has a Mooney viscosity of around 50 and is a highly linear polybutadiene, and Shell 1220 (Co-catalyzed). If desired, the polybutadiene can also be mixed with other elastomers known in the art, such as other polybutadiene rubbers, natural rubber, styrene butadiene rubber, and/or isoprene rubber in order to further modify the properties of the core. When a mixture of elastomers is used, the amounts of other constituents in the core composition are typically based on 100 parts by weight of the total elastomer mixture.

In one preferred embodiment, the base rubber comprises a Nd-catalyzed polybutadiene, a rare earth-catalyzed polybutadiene rubber, or blends thereof. If desired, the polybutadiene can also be mixed with other elastomers known in the art such as natural rubber, polyisoprene rubber and/or styrene-butadiene rubber in order to modify the properties of the core. Other suitable base rubbers include thermosetting materials such as, ethylene propylene diene monomer rubber, ethylene propylene rubber, butyl rubber, halobutyl rubber, hydrogenated nitrile butadiene rubber, nitrile rubber, and silicone rubber.

Thermoplastic elastomers (TPE) many also be used to modify the properties of the core layers, or the uncured core layer stock by blending with the base thermoset rubber. These TPEs include natural or synthetic balata, or high trans-polyisoprene, high trans-polybutadiene, or any styrenic block copolymer, such as styrene ethylene butadiene styrene, styrene-isoprene-styrene, etc., a metallocene or other single-site catalyzed polyolefin such as ethylene-octene, or ethylene-butene, or thermoplastic polyurethanes (TPU), including copolymers, e.g. with silicone. Other suitable TPEs for blending with the thermoset rubbers of the present invention include PEBAX®, which is believed to comprise polyether amide copolymers, HYTREL®, which is believed to comprise polyether ester copolymers, thermoplastic urethane, and KRATON®, which is believed to comprise styrenic block copolymers elastomers. Any of the TPEs or TPUs above may also contain functionality suitable for grafting, including maleic acid or maleic anhydride.

Additional polymers may also optionally be incorporated into the base rubber. Examples include, but are not limited to, thermoset elastomers such as core regrind, thermoplastic vulcanizate, copolymeric ionomer, terpolymeric ionomer, polycarbonate, polyamide, copolymeric polyamide, polyesters, polyvinyl alcohols, acrylonitrile-butadiene-styrene copolymers, polyarylate, polyacrylate, polyphenylene ether, impact-modified polyphenylene ether, high impact polystyrene, diallyl phthalate polymer, styrene-acrylonitrile polymer (SAN) (including olefin-modified SAN and acrylonitrile-styrene-acrylonitrile polymer), styrene-maleic anhydride copolymer, styrenic copolymer, functionalized styrenic copolymer, functionalized styrenic terpolymer, styrenic terpolymer, cellulose polymer, liquid crystal polymer, ethylene-vinyl acetate copolymers, polyurea, and polysiloxane or any metallocene-catalyzed polymers of these species.

Suitable polyamides for use as an additional polymeric material in compositions within the scope of the present invention also include resins obtained by: (1) polycondensation of (a) a dicarboxylic acid, such as oxalic acid, adipic acid, sebacic acid, terephthalic acid, isophthalic acid, or 1,4-cyclohexanedicarboxylic acid, with (b) a diamine, such as ethylenediamine, tetramethylenediamine, pentamethylenediamine, hexamethylenediamine, or decamethylenediamine, 1,4-cyclohexanediamine, or m-xylylenediamine; (2) a ring-opening polymerization of cyclic lactam, such as ϵ-caprolactam or Ω-laurolactam; (3) polycondensation of an aminocarboxylic acid, such as 6-aminocaproic acid, 9-aminononanoic acid, 11-aminoundecanoic acid, or 12-aminododecanoic acid; or (4) copolymerization of a cyclic lactam with a dicarboxylic acid and a diamine. Specific examples of suitable polyamides include Nylon 6, Nylon 66, Nylon 610, Nylon 11, Nylon 12, copolymerized Nylon, Nylon MXD6, and Nylon 46.

Suitable peroxide-initiating agents include dicumyl peroxide; 2,5-dimethyl-2,5-di(t-butylperoxy) hexane; 2,5-dimethyl-2,5-di(t-butylperoxy)hexyne; 2,5-dimethyl-2,5-di (benzoylperoxy)hexane; 2,2'-bis(t-butylperoxy)-di-isopropylbenzene; 1,1-bis(t-butylperoxy)-3,3,5-trimethyl cyclohexane; n-butyl 4,4-bis(t-butyl-peroxy)valerate; t-butyl perbenzoate; benzoyl peroxide; n-butyl 4,4'-bis(butylperoxy) valerate; di-t-butyl peroxide; or 2,5-di-(t-butylperoxy)-2,5-dimethyl hexane, lauryl peroxide, t-butyl hydroperoxide, α-α bis(t-butylperoxy)diisopropylbenzene, di(2-t-butyl-peroxy-isopropyl)benzene, di-t-amyl peroxide, di-t-butyl peroxide. Preferably, the rubber composition includes from about 0.25 to about 5.0 parts by weight peroxide per 100 parts by weight rubber (phr), more preferably 0.5 phr to 3 phr, most preferably 0.5 phr to 1.5 phr. In a most preferred embodiment, the peroxide is present in an amount of about 0.8 phr. These ranges of peroxide are given assuming the peroxide is 100% active, without accounting for any carrier that might be present. Because many commercially available peroxides are sold along with a carrier compound, the actual amount of active peroxide present must be calculated. Commercially-available peroxide initiating agents include DICUP™ family of dicumyl peroxides (including DICUP™ R, DICUP™ 40C and DICUP™ 40KE) available from Crompton (Geo Specialty Chemicals). Similar initiating agents are available from AkroChem, Lanxess, Flexsys/Harwick and R.T. Vanderbilt. Another commercially-available and preferred initiating agent is TRIGONOX™ 265-50B from Akzo Nobel, which is a mixture of 1,1-di(t-butylperoxy)-3,3,5-trimethylcyclohexane and di(2-t-butylperoxyisopropyl)benzene. TRIGONOX™ peroxides are generally sold on a carrier compound.

Suitable reactive co-agents include, but are not limited to, metal salts of diacrylates, dimethacrylates, and monomethacrylates suitable for use in this invention include those wherein the metal is zinc, magnesium, calcium, barium, tin, aluminum, lithium, sodium, potassium, iron, zirconium, and bismuth. Zinc diacrylate (ZDA) is preferred, but the present invention is not limited thereto. ZDA provides golf balls with a high initial velocity. The ZDA can be of various grades of purity. For the purposes of this invention, the lower the quantity of zinc stearate present in the ZDA the higher the ZDA purity. ZDA containing less than about 10% zinc stearate is preferable. More preferable is ZDA containing about 4-8% zinc stearate. Suitable, commercially available zinc diacrylates include those from Sartomer Co. The preferred concentrations of ZDA that can be used are about 10 phr to about 40 phr, more preferably 20 phr to about 35 phr, most preferably 25 phr to about 35 phr. In a particularly preferred embodiment, the reactive co-agent is present in an amount of about 29 phr to about 31 phr.

Additional preferred co-agents that may be used alone or in combination with those mentioned above include, but are not limited to, trimethylolpropane trimethacrylate, trimethylolpropane triacrylate, and the like. It is understood by those skilled in the art, that in the case where these co-agents may be liquids at room temperature, it may be advantageous to disperse these compounds on a suitable carrier to promote ease of incorporation in the rubber mixture.

Antioxidants are compounds that inhibit or prevent the oxidative breakdown of elastomers, and/or inhibit or prevent reactions that are promoted by oxygen radicals. Some exemplary antioxidants that may be used in the present invention include, but are not limited to, quinoline type antioxidants, amine type antioxidants, and phenolic type antioxidants. A preferred antioxidant is 2,2'-methylene-bis-(4-methyl-6-t-butylphenol) available as VANOX® MBPC from R.T. Vanderbilt. Other polyphenolic antioxidants include VANOX® T, VANOX® L, VANOX® SKT, VANOX® SWP, VANOX® 13 and VANOX® 1290.

Suitable antioxidants include, but are not limited to, alkylene-bis-alkyl substituted cresols, such as 4,4'-methylene-bis (2,5-xylenol); 4,4'-ethylidene-bis-(6-ethyl-m-cresol); 4,4'-butylidene-bis-(6-t-butyl-m-cresol); 4,4'-decylidene-bis-(6-methyl-m-cresol); 4,4'-methylene-bis-(2-amyl-m-cresol); 4,4'-propylidene-bis-(5-hexyl-m-cresol); 3,3'-decylidene-bis-(5-ethyl-p-cresol); 2,2'-butylidene-bis-(3-n-hexyl-p-cresol); 4,4'-(2-butylidene)-bis-(6-t-butyl-m-cresol); 3,3'-4 (decylidene)-bis-(5-ethyl-p-cresol); (2,5-dimethyl-4-hydroxyphenyl) (2-hydroxy-3,5-dimethylphenyl) methane; (2-methyl-4-hydroxy-5-ethylphenyl) (2-ethyl-3-hydroxy-5-methylphenyl) methane; (3-methyl-5-hydroxy-6-t-butylphenyl) (2-hydroxy-4-methyl-5-decylphenyl)-n-butyl methane; (2-hydroxy-4-ethyl-5-methylphenyl) (2-decyl-3-hydroxy-4-methylphenyl)butylamylmethane; (3-ethyl-4-methyl-5-hydroxyphenyl)-(2,3-dimethyl-3-hydroxy-phenyl)nonylmethane; (3-methyl-2-hydroxy-6-ethylphenyl)-(2-isopropyl-3-hydroxy-5-methyl-phenyl)cyclohexylmethane; (2-methyl-4-hydroxy-5-methylphenyl) (2-hydroxy-3-methyl-5-ethylphenyl)dicyclohexyl methane; and the like.

The antioxidant is typically present in an amount of about 0.1 phr to about 5 phr, preferably from about 0.1 phr to about 2 phr, more preferably about 0.1 phr to about 1 phr. In a particularly preferred embodiment, the antioxidant is present in an amount of about 0.4 phr.

In an alternative embodiment, the antioxidant should be present in an amount to ensure that the hardness gradient of the inventive cores is negative. Preferably, about 0.2 phr to about 1 phr antioxidant is added to the core layer (inner core or outer core layer) formulation, more preferably, about 0.3 to about 0.8 phr, and most preferably 0.4 to about 0.7 phr. Preferably, about 0.25 phr to about 1.5 phr of peroxide as calculated at 100% active can be added to the core formulation, more preferably about 0.5 phr to about 1.2 phr, and most preferably about 0.7 phr to about 1.0 phr. The ZDA amount can be varied to suit the desired compression, spin and feel of the resulting golf ball. The cure regime can have a temperature range between from about 290° F. to about 335° F., more preferably about 300° F. to about 325° F., and the stock is held at that temperature for at least about 10 minutes to about 30 minutes.

The thermoset rubber composition of the present invention may also include an optional soft and fast agent. As used herein, "soft and fast agent" means any compound or a blend thereof that that is capable of making a core 1) be softer (lower compression) at constant COR or 2) have a higher COR at equal compression, or any combination thereof, when compared to a core equivalently prepared without a soft and fast agent. Preferably, the composition of the present invention contains from about 0.05 phr to about 10.0 phr soft and fast agent. In one embodiment, the soft and fast agent is present in an amount of about 0.05 phr to about 3.0 phr, preferably about 0.05 phr to about 2.0 phr, more preferably about 0.05 phr to about 1.0 phr. In another embodiment, the soft and fast agent is present in an amount of about 2.0 phr to about 5.0 phr, preferably about 2.35 phr to about 4.0 phr, and more preferably about 2.35 phr to about 3.0 phr. In an alternative high concentration embodiment, the soft and fast agent is present in an amount of about 5.0 phr to about 10.0 phr, more preferably about 6.0 phr to about 9.0 phr, most preferably about 7.0 phr to about 8.0 phr. In a most preferred embodiment, the soft and fast agent is present in an amount of about 2.6 phr.

Suitable soft and fast agents include, but are not limited to, organosulfur or metal-containing organosulfur compounds, an organic sulfur compound, including mono, di, and polysulfides, a thiol, or mercapto compound, an inorganic sulfide compound, a Group VIA compound, or mixtures thereof. The soft and fast agent component may also be a blend of an organosulfur compound and an inorganic sulfide compound. Preferably, the halogenated thiophenol compound is pentachlorothiophenol, which is commercially available in neat form or under the tradename STRUKTOL®, a clay-based carrier containing the sulfur compound pentachlorothiophenol loaded at 45 percent (correlating to 2.4 parts PCTP). STRUKTOL® is commercially available from Struktol Company of America of Stow, Ohio. PCTP is commercially available in neat form from eChinachem of San Francisco, Calif. and in the salt form from eChinachem of San Francisco, Calif.

Most preferably, the halogenated thiophenol compound is the zinc salt of pentachlorothiophenol, which is commercially available from eChinachem of San Francisco, Calif. Other suitable soft and fast agents include, but are not limited to, hydroquinones, benzoquinones, quinhydrones, catechols, and resorcinols.

Fillers may also be added to the thermoset rubber composition of the core to adjust the density of the composition, up or down. Typically, fillers include materials such as tungsten, zinc oxide, barium sulfate, silica, calcium carbonate, zinc carbonate, metals, metal oxides and salts, regrind (recycled core material typically ground to about 30 mesh particle), high-Mooney-viscosity rubber regrind, trans-regrind core material (recycled core material containing high trans-isomer of polybutadiene), and the like. When trans-regrind is present, the amount of trans-isomer is preferably between about 10% and about 60%. In a preferred embodiment of the invention, the core comprises polybutadiene having a cis-isomer content of greater than about 95% and trans-regrind core material (already vulcanized) as a filler. Any particle size trans-regrind core material is sufficient, but is preferably less than about 125 μm.

Fillers added to one or more portions of the golf ball typically include processing aids or compounds to affect rheological and mixing properties, density-modifying fillers, tear strength, or reinforcement fillers, and the like. The fillers are generally inorganic, and suitable fillers include numerous metals or metal oxides, such as zinc oxide and tin oxide, as well as barium sulfate, zinc sulfate, calcium carbonate, barium carbonate, clay, tungsten, tungsten carbide, an array of silicas, and mixtures thereof. Fillers may also include various foaming agents or blowing agents which may be readily selected by one of ordinary skill in the art. Fillers may include polymeric, ceramic, metal, and glass microspheres may be solid or hollow, and filled or unfilled. Fillers are typically also added to one or more portions of the golf ball to modify the density thereof to conform to uniform golf ball standards. Fillers may also be used to modify the weight of the center or at least one additional layer for specialty balls, e.g., a lower weight ball is preferred for a player having a low swing speed. Materials such as tungsten, zinc oxide, barium sulfate, silica, calcium carbonate, zinc carbonate, metals, metal oxides and salts, and regrind (recycled core material typically ground to about 30 mesh particle) are also suitable fillers.

The polybutadiene and/or any other base rubber or elastomer system may also be foamed, or filled with hollow microspheres or with expandable microspheres which expand at a set temperature during the curing process to any low specific gravity level. Other ingredients such as sulfur accelerators, e.g., tetra methylthiuram di, tri, or tetrasulfide, and/or metal-containing organosulfur components may also be used according to the invention. Suitable metal-containing organosulfur accelerators include, but are not limited to, cadmium, copper, lead, and tellurium analogs of diethyldithiocarbamate, diamyldithiocarbamate, and dimethyldithiocarbamate, or mixtures thereof. Other ingredients such as processing aids e.g., fatty acids and/or their metal salts, processing oils, dyes and pigments, as well as other additives known to one skilled in the art may also be used in the present invention in amounts sufficient to achieve the purpose for which they are typically used.

Some examples of the present invention include the following three preferred embodiments. The golf ball may contain a "dual-core," in which both the inner core and outer core layer have a "negative" hardness gradient, optionally a zero gradient. In the first preferred embodiment, a "low spin" embodiment, the inner surface of the outer core layer is harder than the outer surface of the inner core. The second preferred embodiment, a "high spin" embodiment, the inner surface of the outer core layer is softer than the outer surface of the inner core. In a third preferred embodiment, the hardness of the inner surface of the outer core layer is substantially identical to the hardness of the outer surface of the inner core, effectively providing a continuous "negative" gradient extending from the outer surface of the outer core layer to the center of the solid center.

In the "low spin" embodiment, the hardness of the inner core (at any point—surface, center, or otherwise) ranges from 30 Shore C to 80 Shore C, more preferably 40 Shore C to 75 Shore C, most preferably 45 Shore C to 70 Shore C. Concurrently, the hardness of the outer core layer (at any point—surface, inner surface, or otherwise) ranges from 60 Shore C to 95 Shore C, more preferably 60 Shore C to 90 Shore C, most preferably 65 Shore C to 80 Shore C.

In the "high spin" embodiment, the hardness of the inner core ranges from 60 Shore C to 95 Shore C, more preferably 60 Shore C to 90 Shore C, most preferably 65 Shore C to 80 Shore C. Concurrently, the hardness of the outer core layer ranges from 30 Shore C to 80 Shore C, more preferably 40 Shore C to 75 Shore C, most preferably 45 Shore C to 70 Shore C.

In the embodiment where the interface (i.e., the area where the two components meet) of the outer core layer and the inner core has substantially the same hardness, the ranges provided for either the "low spin" or "high spin" embodiments are sufficient, as long as the "negative" hardness gradient is maintained and the hardness value at the inner surface of the outer core layer is roughly the same as the hardness value at the outer surface of the inner core.

Figure 2:
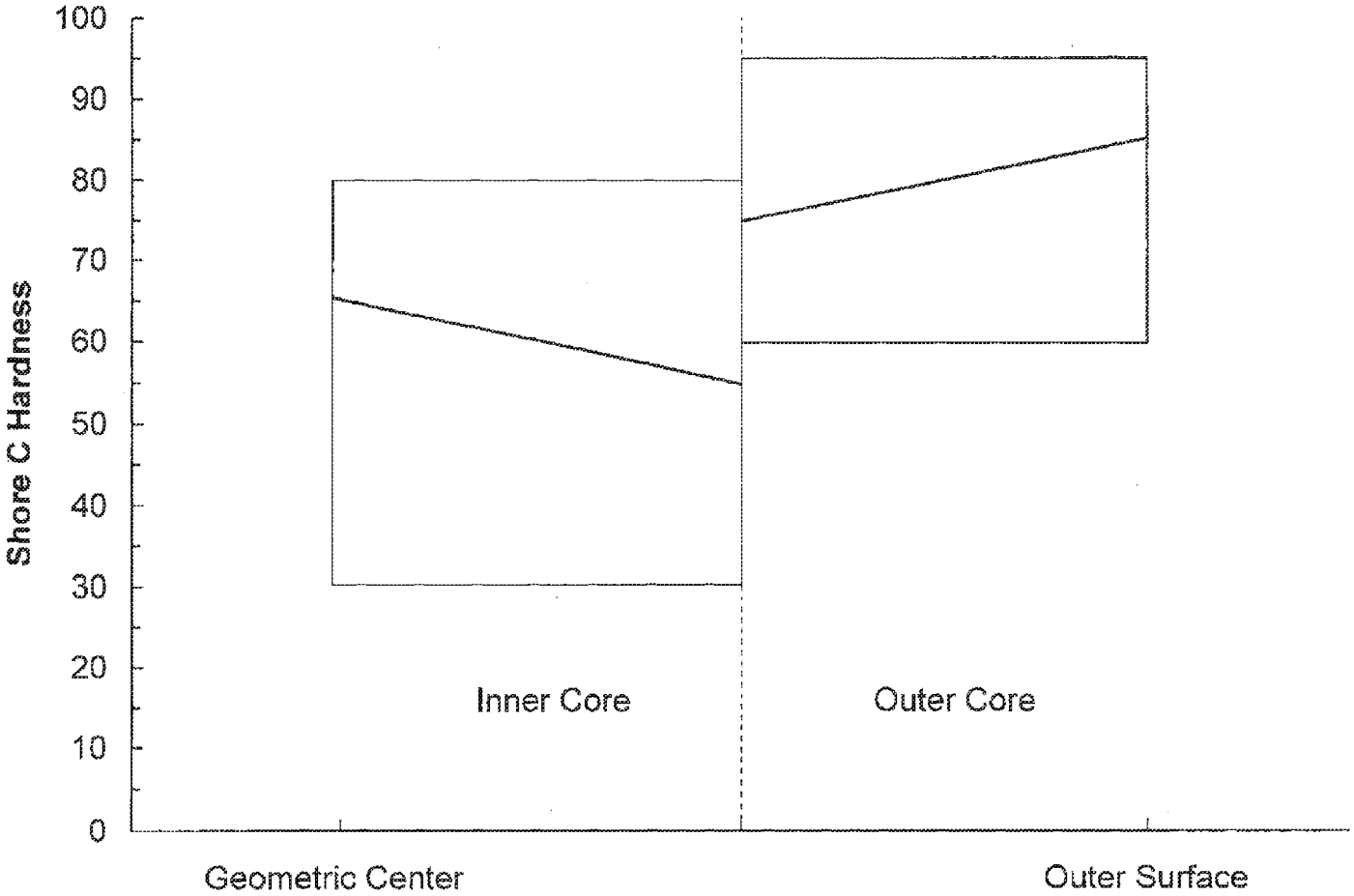
FIG. 2 is a graph depicting preferred hardness ranges for a "low spin" embodiment of the present invention.
Figure 3:
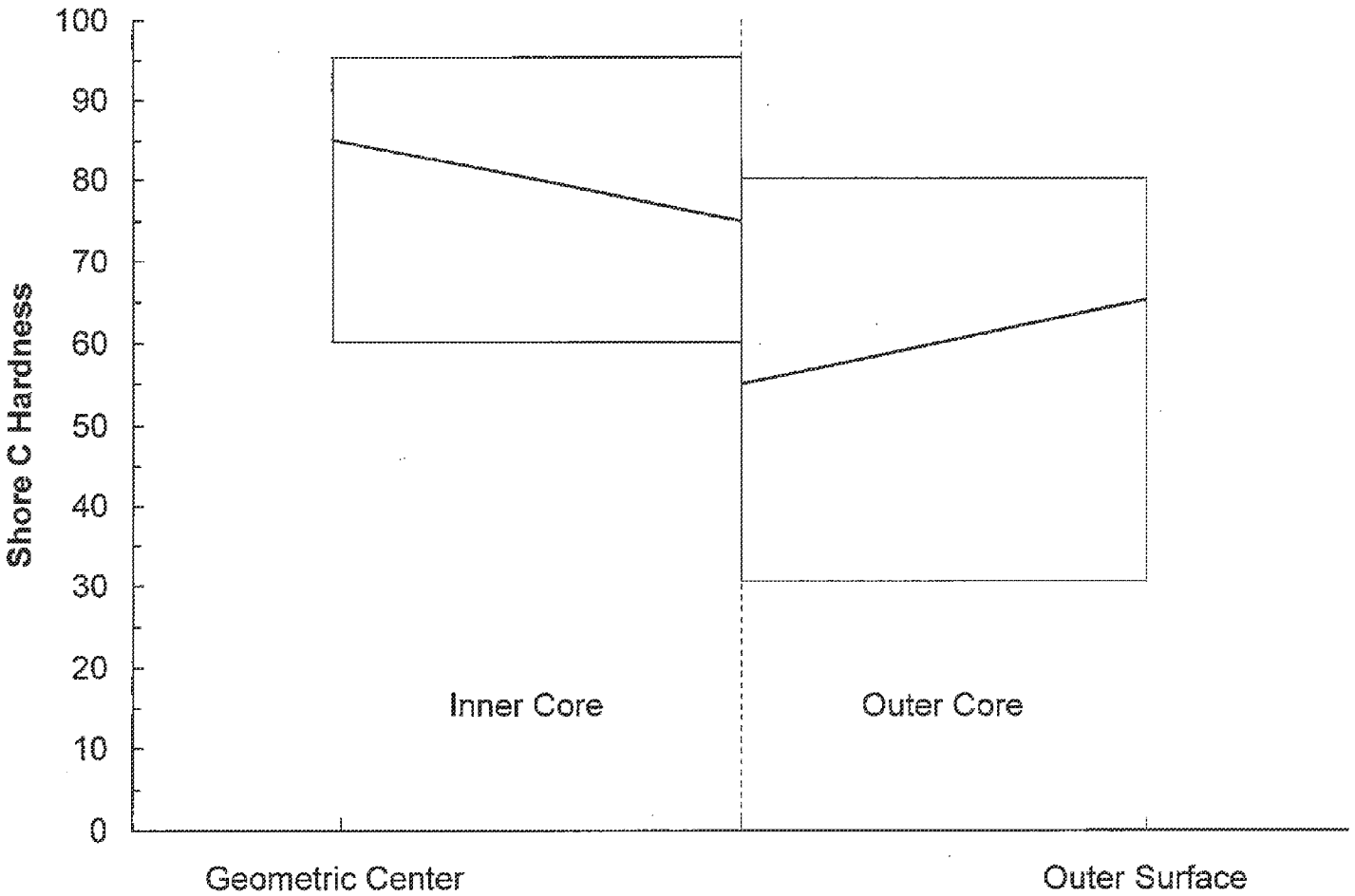
FIG. 3 is a graph depicting preferred hardness ranges for a "high spin" embodiment, of the present invention.

Representative graphs depicting the hardness regions in which the "negative" hardness gradients disclosed herein can reside are shown in FIGS. 2 and 3. The "negative" gradients, particularly in the above embodiments, can have any slope (i.e., steep, shallow, or substantially flat). In certain embodiments, a point or plurality of points measured along the "negative" gradient may be above or below a line fit through the gradient and its outermost and innermost hardness values. In an alternative preferred embodiment, the hardest point along a particular "negative" gradient may be higher than the value at the innermost portion of the inner core (the geometric center) or outer core layer (the inner surface)—as long as the outermost point (i.e., the outer surface of the inner core) is about the same or lower than the innermost point (i.e., the geometric center of the inner core), the "negative" gradient remains intact.

There are a number of suitable and alternative "low spin" embodiments, each of which provide a varying degree of golf ball performance properties. In each of the following three embodiments, the inner core preferably has an outer diameter of about 1.00 inch and the core (the combination of the inner core and the outer core layer) preferably has an outer diameter of about 1.53 inches. Any cover material listed above would be suitable and an inner cover may or may not be present. Preferably, an inner cover layer is present and it an ionomer-based material, such as a highly-neutralized ionomer, and preferably the outer cover is formed from a urethane or urea material.

(A). A golf ball having a core formed from an inner core and an outer core layer. The inner core center hardness is about 42 Shore C and the surface hardness is about 37 Shore C, exhibiting the "negative" hardness gradient of the present invention. The inner surface of the outer core layer has a hardness of about 79 Shore C and the outer surface has a hardness of about 73 Shore C, again exhibiting the "negative" gradient of the invention. The Atti compression of this core is preferably about 60 and the COR is about 0.790. The antioxidant (AO):initiator ratio of the inner core is about 0.5 and the ZDA level is about 8-10 phr. The antioxidant:initiator ratio of the outer core layer is about 0.4 and the ZDA level is about 32-34 phr. The cure temperature and time for both the inner core and outer core layer is about 315° F. for 11 min.

(B) A golf ball having a core formed from an inner core and an outer core layer. The inner core center hardness is about 56 Shore C and the surface hardness is about 55 Shore C, exhibiting the "negative" hardness gradient of the present invention. The inner surface of the outer core layer has a hardness of about 89 Shore C and the outer surface has a hardness of about 82 Shore C, again exhibiting the "negative" gradient of the invention. The Atti compression of this core is preferably about 70 and the COR is about 0.805. The antioxidant:initiator ratio of the inner core is about 0.5 and the ZDA level is about 10-12 phr. The antioxidant:initiator ratio of the outer core layer is about 0.5 and the ZDA level is about 34-36 phr. The cure temperature and time for both the inner core and outer core layer is about 320° F. for 11 min.

(C) A golf ball having a core formed from an inner core and an outer core layer. The inner core center hardness is about 46 Shore C and the surface hardness is about 44 Shore C, exhibiting the "negative" hardness gradient of the present invention. The inner surface of the outer core layer has a hardness of about 62 Shore C and the outer surface has a hardness of about 58 Shore C, again exhibiting the "negative" gradient of the invention. The Atti compression of this core is preferably about 65 and the COR is about 0.800. The antioxidant:initiator ratio of the inner core is about 0.4 and the ZDA level is about 8-10 phr. The antioxidant:initiator ratio of the outer core layer is about 0.3 and the ZDA level is about 26-28 phr. The cure temperature and time for both the inner core and outer core layer is about 315° F. for 11 min.

There are also a number of suitable and alternative "high spin" embodiments which provide a varying degree of golf ball performance properties different from those exhibited by the "low spin" embodiments. As above, in each of the following three embodiments, the inner core preferably has an outer diameter of about 1.00 inch and the core (the combination of the inner core and the outer core layer) preferably has an outer diameter of about 1.53 inches.

(A) A golf ball having a core formed from an inner core and an outer core layer. The inner core center hardness is about 74 Shore C and the surface hardness is about 71 Shore C, exhibiting the "negative" hardness gradient of the present invention. The inner surface of the outer core layer has a hardness of about 68 Shore C and the outer surface has a hardness of about 63 Shore C, again exhibiting the "negative" gradient of the invention. The Atti compression of this core is preferably about 68 and the COR is about 0.790. The antioxidant:initiator ratio of the inner core is about 0.5 and the ZDA level is about 28-30 phr. The antioxidant:initiator ratio of the outer core layer is about 0.4 and the ZDA level is about 12-14 phr. The cure temperature and time for the inner core is about 320° F. for 14 min, and for the outer core layer about 320° F. for 11 min.

(B) A golf ball having a core formed from an inner core and an outer core layer. The inner core center hardness is about 86 Shore C and the surface hardness is about 83 Shore C, exhibiting the "negative" hardness gradient of the present invention. The inner surface of the outer core layer has a hardness of about 61 Shore C and the outer surface has a hardness of about 57 Shore C, again exhibiting the "negative" gradient of the invention. The Atti compression of this core is preferably about 74 and the COR is about 0.800. The antioxidant:initiator ratio of the inner core is about 0.4 and the ZDA level is about 33-35 phr. The antioxidant:initiator ratio of the outer core layer is about 0.5 and the ZDA level is about 11-13 phr. The cure temperature and time for the inner core is about 320° F. for 14 min, and for the outer core layer about 315° F. for 11 min.

(C) A golf ball having a core formed from an inner core and an outer core layer. The inner core center hardness is about 65 Shore C and the surface hardness is about 61 Shore C, exhibiting the "negative" hardness gradient of the present invention. The inner surface of the outer core layer has a hardness of about 52 Shore C and the outer surface has a hardness of about 49 Shore C, again exhibiting the "negative" gradient of the invention. The Atti compression of this core is preferably about 62 and the COR is about 0.785. The antioxidant:initiator ratio of the inner core is about 0.5 and the ZDA level is about 25-27 phr. The antioxidant:initiator ratio of the outer core layer is about 0.5 and the ZDA level is about 9-11 phr. The cure temperature and time for the inner core is about 315° F. for 14 min, and for the outer core layer about 315° F. for 11 min.

Alternative embodiments include a golf ball where the hardness of the outer surface of the inner core generally ranges from 42 Shore C to 60 Shore C and the hardness of the geometric center of the inner core generally ranges from 52 Shore C to 65 Shore C such that the "positive hardness gradient" has a magnitude of about 0 to −10. In this embodiment, the hardness of the outer surface of the outer core layer generally ranges from 62 Shore C to 89 Shore C and the hardness of the inner surface of the outer core layer generally ranges from 58 Shore C to 82 Shore C such that the "negative hardness gradient" has a magnitude of about 10 to 20.

Additionally, the hardness of the outer surface of the inner core may range from 61 Shore C to 83 Shore C and the hardness of the geometric center of the inner core may range from 65 Shore C to 86 Shore C such that the "positive hardness gradient" has a magnitude of about 0 to −10. In this embodiment, the hardness of the outer surface of the outer core layer generally ranges from 52 Shore C to 68 Shore C and the hardness of the inner surface of the outer core layer generally ranges from 49 Shore C to 63 Shore C such that the "negative hardness gradient" has a magnitude of about 10 to 20.

The above embodiments may be tailored to meet predetermined performance properties. For example, alternative embodiments include those having an inner core having an outer diameter of about 0.250 inches to about 1.550 inches, preferably about 0.500 inches to about 1.500 inches, and more preferably about 0.750 inches to about 1.400 inches. In preferred embodiments, the inner core has an outer diameter of about 1.000 inch, 1.200 inches, or 1.300 inches, with a most preferred outer diameter being 1.130 inches. The outer core layer should have an outer diameter (the entire dual-core) of about 1.30 inches to about 1.620 inches, preferably 1.400 inches to about 1.600 inches, and more preferably about 1.500 inches to about 1.590 inches. In preferred embodiments, the outer core layer has an outer diameter of about 1.510 inches, 1.530 inches, or most preferably 1.550 inches.

In accordance with the present invention, it now has been found that rubber compositions comprising "cycloalkene rubber" can be used to provide a golf ball having improved resiliency and rebounding properties along with a soft feel. Cycloalkene rubbers are rubbery polymers made from one or more cycloalkenes having from 5 to 20, preferably 5 to 15, ring carbon atoms. The cycloalkene rubbers (also referred to as polyalkenylene or polyalkenamer rubbers) may be prepared by ring opening metathesis polymerization of one or more cycloalkenes in the presence of organometallic catalysts as is known in the art. Such polymerization methods are disclosed, for example, in U.S. Pat. Nos. 3,492,245 and 3,804,803, the disclosures of which are hereby incorporated by reference. By the term, "cycloalkene rubber" as used herein, it is meant a compound having at least 20 weight % macrocycles (cyclic content). The cyclic and linear portions of the cycloalkene rubber have the following general chemical structures:

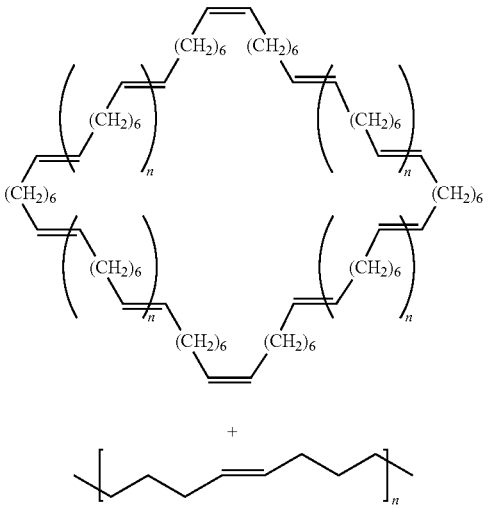

n = 30 - 10000

Suitable cyclic olefins that can be used to make the cycloalkene rubber include unsaturated hydrocarbons with 4 to 12 ring carbon atoms in one or more rings e.g., 1-3 rings, which exhibit in at least one ring an unsubstituted double bond which is not in conjugation to a second double bond which may be present and which may have any degree of substitution; the substituents must not interfere with the metathesis catalysts and are preferably alkyl groups of 1 to 4 carbon atoms or a part of a cyclic structure of 4 to 8 carbon atoms. Examples are cyclobutene, cyclopentene, cycloheptene, cis- and trans-cyclooctene, cyclononene, cyclodecene, cycloundecene, cis- and trans-cyclododecene, cis, cis-cyclooctadiene, 1-methyl-1,5-cyclooctadiene, 3-methyl-1,5-cyclooctadiene, and 3,7-dimethyl-1,5-cyclooctadiene.

Examples of suitable polyalkenamer rubbers are polypentenamer rubber, polyheptenamer rubber, polyoctenamer rubber, polydecenamer rubber and polydodecenamer rubber. Polyoctenamer rubbers are commercially available from Evonik Degussa GmbH of Marl, Germany and sold under the VESTENAMER tradename. The polyalkenamer rubber used in the present invention preferably has a trans-bond content of about 55% or greater and a second heat melting point of about 30° C. or greater. More preferably, the cycloalkene rubber has a trans-bond content of 75% or greater and a second heat melting point of 50° C. or greater. Furthermore, the polyalkenamer rubber material preferably has a molecular weight of about 80,000 or greater (measured according to GPC); a glass transition temperature (Tg) of about 55° C. or less (measured according to ISO 6721 or 4663); a cis-to-trans ratio of double bonds of about 40:60 or preferably about 20:80 (measured according to IR); a Mooney viscosity ML (1+4) 100° C. of less than about 10 (measured according to DIN 53 523 or ASTM-D 1646); a viscosity number J/23° C. of about 130 or preferably about 120 ml/g (measured according to ISO 1628-1); and a density of about 0.9 g/cm$^3$ or greater (measured according to DIN 53 479 A or ISO 1183).

The polyalkenamer rubber compound, of and by itself, has relatively high crystallinity. For example, a specific grade of polyalkenamer rubber (VESTENAMER 8012) has a crystallinity of approximately 30% (measured by DSC, second melting.) The ratio of cis double bonds to trans double bonds (cis/trans ratio) in the polymer is significant in determining the degree of crystallinity in the polymer. In general, if the trans-bond content of the polymer is relatively high, the crystallinity and melting point of the polymer is relatively high. That is, as the trans-bond content increases, the crystallinity of the polymer increases. The polyalkenamer rubber, VESTENAMER 8012 has a trans-bond content of about 80%. In accordance with the present invention, it has been found the compression of polyalkenamer rubber cores is reduced and the Coefficient of Restitution ("COR") of the cores is increased when the rubber composition is cross-linked to a relatively high degree and the composition does not contain a reactive cross-linking co-agent such as zinc diacrylate (ZDA). The polyalkenamer rubber composition may be cured using a conventional curing process such as peroxide-curing, sulfur-curing, and high-energy radiation, and combinations thereof. For example, the composition may be peroxide-cured. When peroxide is added at relatively high amounts (particularly, at least 2.5 and preferably 5.0 phr) and the composition (which if it does not contain a reactive cross-linking co-agent such as ZDA) is cured to cross-link the rubber chains, then the compression of the polyalkenamer rubber cores is reduced and the COR of the cores is increased. It is believed this phenomenon is due, at least in part, to disrupting the crystalline structure of the polymer by curing and cross-linking the composition in accordance with this invention. While not wishing to be bound by any theory, it is believed the cross-linking causes the tightly packed structures within the mass of polyalkenamer polymer to spread out, thus disrupting the crystallinity of the material. It appears the crystallinity may be partially disrupted and the polymer remains in a partially crystalline state. As a result, the polyalkenamer rubber (which if it does not contain a reactive cross-linking agent such as ZDA) becomes softer and more rubbery and the compression of core samples made from the composition decreases.

One example of a commercially-available material that can be used in accordance with this invention is VESTENAMER 8012 (trans-bond content of about 80% and a melting point of about 54° C.). The material, VESTENAMER 6213 (trans-bond content of about 60% and a melting point of about 30°) also may be effective.

In the present invention, it has been found that rubber compositions comprising polyoctenamer rubber are particularly effective. Polyoctenamer rubber compositions can be used to make a core that provides the golf ball with good rebounding properties (distance) without sacrificing a nice feel to the ball. The resulting ball has a relatively high COR allowing it to reach a high velocity when struck by a golf club. Thus, the ball tends to travel a greater distance which is particularly important for driver shots off the tee. Meanwhile, the soft feel of the ball provides the player with a more pleasant sensation when he/she strikes the ball with the club. The player senses more control over the ball as the club face makes impact. Furthermore, the soft feel of the ball's cover allows players to place a spin on the ball and better control its flight pattern which is particularly important for approach shots near the green.

The polyalkenamer rubber is used in an amount of at least 50% by weight based on total amount of polymer in the rubber composition used to make the core. Preferably, the polyalkenamer rubber is present in an amount of 65 to 100% by weight and more preferably 75 to 100% by weight based on total polymer weight. It is believed that when the concentration of the polyalkenamer rubber is less than 50% by weight, the resiliency of the rubber composition is not significantly improved. In particular versions, the blend may contain a lower concentration of polylakenamer rubber in the amount of 50%, 55%, 60%, 65%, or 70% and an upper concentration of polyalkenamer in the amount of 75%, 80%, 85%, 90%, or 95%.

The polyalkenamer rubber may be blended with other rubber and polymeric materials. As described above, these rubber materials include, but are not limited to, polybutadiene, polyisoprene, ethylene propylene rubber ("EPR"), ethylene propylene diene rubber ("EPDM"), styrene-butadiene rubber, styrenic block copolymer rubbers (such as SI, SIS, SB, SBS, SIBS, SEBS, and the like, where "S" is styrene, "I" is isobutylene, "B" is butadiene, and "E" is ethylene), butyl rubber, halobutyl rubber, polystyrene elastomers, polyethylene elastomers, polyurethane elastomers, polyurea elastomers, metallocene-catalyzed elastomers and plastomers, copolymers of isobutylene and para-alkylstyrene, halogenated copolymers of isobutylene and para-alkylstyrene, copolymers of butadiene with acrylonitrile, polychloroprene, alkyl acrylate rubber, chlorinated isoprene rubber, acrylonitrile chlorinated isoprene rubber, and combinations of two or more thereof. A preferred base rubber is 1,4-polybutadiene having a cis-bond structure of at least 40%, preferably greater than 80%, and more preferably greater than 90%.

Examples of commercially available polybutadiene rubbers that can be used in accordance with this invention include, but are not limited to, BUNA® CB22 and BUNA® CB23, commercially available from Lanxess Corp.; UBEPOL® 360L and UBEPOL® 150L and UBEPOL-BR rubbers, commercially available from UBE Industries, Ltd. of Tokyo, Japan; KINEX® 7245 and KINEX® 7265, commercially available from Goodyear of Akron, Ohio; SE BR-1220, and BUNA® CB1203G1, CB1220, and CB1221, commercially available from Lanxess Corp.; EUROPRENE® NEOCIS® BR 40 and BR 60, commercially available from Polimeri Europa; and BR 01, BR 730, BR 735, BR 11, and BR 51, commercially available from Japan Synthetic Rubber Co., Ltd; and Afdene 45, Afdene 50, Neodene 40, and Neodene 45, commercially available from Karbochem (PTY) Ltd. of Bruma, South Africa.

As discussed above, the polyalkenamer rubber composition may be cured using a conventional curing process. Suitable curing processes include, for example, peroxide-curing, sulfur-curing, high-energy radiation, and combinations thereof. Preferably, the rubber composition contains a free-radical initiator selected from organic peroxides, high energy radiation sources capable of generating free-radicals, and combinations thereof. In one preferred version, the rubber composition is peroxide-cured. Suitable organic peroxides include, but are not limited to, dicumyl peroxide; n-butyl-4,4-di(t-butylperoxy) valerate; 1,1-di(t-butylperoxy)3,3,5-trimethylcyclohexane; 2,5-dimethyl-2,5-di(t-butylperoxy) hexane; di-t-butyl peroxide; di-t-amyl peroxide; t-butyl peroxide; t-butyl cumyl peroxide; 2,5-dimethyl-2,5-di(t-butylperoxy)hexyne-3; di(2-t-butyl-peroxyisopropyl)benzene; dilauroyl peroxide; dibenzoyl peroxide; t-butyl hydroperoxide; and combinations thereof. In a particular embodiment, the free radical initiator is dicumyl peroxide, including, but not limited to Perkadox® BC, commercially available from Akzo Nobel. Peroxide free-radical initiators are generally present in the rubber composition in an amount of at least 0.05 parts by weight per 100 parts of the base rubber, or an amount within the range having a lower limit of 0.05 parts or 0.1 parts or 1 part or 1.25 parts or 1.5 parts or 2.5 parts or 5 parts by weight per 100 parts of the total rubbers, and an upper limit of 2.5 parts or 3 parts or 5 parts or 6 parts or 10 parts or 15 parts by weight per 100 parts of the base rubber. In one preferred version, the peroxide free-radical initiator is present in an amount of at least 2.5 and more preferably 5 parts per hundred (phr). As further discussed in the Examples below, it is believed the high crystallinity of the polyalkenamer rubber is reduced by adding the peroxide at relatively high amounts to the rubber composition and curing the composition so it is cross-linked.

The polyalkenamer rubber composition may further include a reactive cross-linking co-agent. Suitable co-agents include, but are not limited to, metal salts of unsaturated carboxylic acids having from 3 to 8 carbon atoms; unsaturated vinyl compounds and polyfunctional monomers (e.g., trimethylolpropane trimethacrylate); phenylene bismaleimide; and combinations thereof. Particular examples of suitable metal salts include, but are not limited to, one or more metal salts of acrylates, diacrylates, methacrylates, and dimethacrylates, wherein the metal is selected from magnesium, calcium, zinc, aluminum, lithium, and nickel. In a particular embodiment, the co-agent is selected from zinc salts of acrylates, diacrylates, methacrylates, and dimethacrylates. In another particular embodiment, the agent is zinc diacrylate (ZDA). When the co-agent is zinc diacrylate and/or zinc dimethacrylate, the co-agent is typically included in the rubber composition in an amount within the range having a lower limit of 1 or 5 or 10 or 15 or 19 or 20 parts by weight per 100 parts of the total rubber, and an upper limit of 24 or 25 or 30 or 35 or 40 or 45 or 50 or 60 parts by weight per 100 parts of the total rubber.

Radical scavengers such as a halogenated organosulfur, organic disulfide, or inorganic disulfide compounds may be added to the polyalkenamer rubber composition to increase the COR at a given compression. Preferred halogenated organosulfur compounds include, but are not limited to, pentachlorothiophenol (PCTP) and salts of PCTP such as zinc pentachlorothiophenol (ZnPCTP). Using PCTP and ZnPCTP in golf ball inner cores helps produce softer and faster inner cores. The PCTP and ZnPCTP compounds help increase the resiliency and the coefficient of restitution of the core. In a particular embodiment, the soft and fast agent is selected from ZnPCTP, PCTP, ditolyl disulfide, diphenyl disulfide, dixylyl disulfide, 2-nitroresorcinol, and combinations thereof.

The polyalkenamer compositions of the present invention also may include "fillers," which are added to adjust the density and/or specific gravity of the material. As used herein, the term "fillers" includes any compound or composition that can be used to adjust the density and/or other properties of the subject golf ball. Suitable fillers include, but are not limited to, polymeric or mineral fillers, metal fillers, metal alloy fillers, metal oxide fillers and carbonaceous fillers. Fillers can be in the form of flakes, fibers, fibrils, or powders. Regrind, which is ground, recycled core material (for example, ground to about 30 mesh particle size), can also be used. The amount and type of fillers utilized are governed by the amount and weight of other ingredients in the golf ball, since a maximum golf ball weight of 45.93 g (1.62 ounces) has been established by the United States Golf Association (USGA). Suitable fillers generally have a specific gravity from about 2 to 20. In one preferred embodiment, the specific gravity can be about 2 to 6.

Suitable polymeric or mineral fillers include, for example, precipitated hydrated silica, clay, talc, asbestos, glass fibers, aramid fibers, mica, calcium metasilicate, barium sulfate, zinc sulfide, lithopone, silicates, silicon carbide, diatomaceous earth, polyvinyl chloride, carbonates such as calcium carbonate and magnesium carbonate. Suitable metal fillers include titanium, tungsten, aluminum, bismuth, nickel, molybdenum, iron, lead, copper, boron, cobalt, beryllium, zinc, and tin. Suitable metal alloys include steel, brass, bronze, boron carbide whiskers, and tungsten carbide whiskers. Suitable metal oxide fillers include zinc oxide, iron oxide, aluminum oxide, titanium oxide, magnesium oxide, and zirconium oxide. Suitable particulate carbonaceous fillers include graphite, carbon black, cotton flock, natural bitumen, cellulose flock, and leather fiber. Micro balloon fillers such as glass and ceramic, and fly ash fillers can also be used.

As discussed above, the rubber compositions may include antioxidants to prevent the breakdown of the elastomers. However, adding such antioxidants to the composition is optional. It is not necessary to include antioxidants in the polyalkenamer rubber compositions of this invention to form a core having a zero or negative hardness gradient as demonstrated in the Examples below. In addition, the polyalkenamer rubber compositions may optionally include processing aids such as high molecular weight organic acids and salts thereof. Suitable organic acids are aliphatic organic acids, aromatic organic acids, saturated mono-functional organic acids, unsaturated monofunctional organic acids, multi-unsaturated mono-functional organic acids, and dimerized derivatives thereof. Particular examples of suitable organic acids include, but are not limited to, caproic acid, caprylic acid, capric acid, lauric acid, stearic acid, behenic acid, erucic acid, oleic acid, linoleic acid, myristic acid, benzoic acid, palmitic acid, phenylacetic acid, naphthalenoic acid, dimerized derivatives thereof. The organic acids are aliphatic, mono-functional (saturated, unsaturated, or multi-unsaturated) organic acids. Salts of these organic acids may also be employed. The salts of organic acids include the salts of barium, lithium, sodium, zinc, bismuth, chromium, cobalt, copper, potassium, strontium, titanium, tungsten, magnesium, cesium, iron, nickel, silver, aluminum, tin, or calcium, salts of fatty acids, particularly stearic, behenic, erucic, oleic, linoelic or dimerized derivatives thereof. It is preferred that the organic acids and salts of the present invention be relatively non-migratory (they do not bloom to the surface of the polymer under ambient temperatures) and non-volatile (they do not volatilize at temperatures required for melt-blending.)

Other ingredients such as accelerators (for example, tetra methylthiuram), processing aids, dyes and pigments, wetting agents, surfactants, plasticizers, coloring agents, fluorescent agents, chemical blowing and foaming agents, defoaming agents, stabilizers, softening agents, impact modifiers, antioxidants, antiozonants, as well as other additives known in the art may be added to the rubber composition. The core may be formed by mixing and molding the rubber composition using conventional techniques. These cores can be used to make finished golf balls by surrounding the core with outer core layer(s), intermediate layer(s), and/or cover materials as discussed further below.

Compression and Coefficient of Restitution ("COR") are important properties of the golf balls of this invention. Methods for measuring COR and compression are described in further detail below. The golf balls typically have a COR of 0.70 or greater, preferably 0.75 or greater, and more preferably 0.78 or greater and a compression of 40 or greater, or a compression within a range having a lower limit of 50 or 60 and an upper limit of 100 or 120, preferably 90 to 100. In one embodiment of a dual-core golf ball, the inner core layer preferably has a compression of 20 or less. The cores of the present invention preferably have an overall compression within a range having a lower limit of 40 or 50 or 60 or 65 or 70 or 75 and an upper limit of 80 or 85 or 90 or 100 or 110 or 120, or an overall compression of about 90. In addition, the golf balls typically will have dimple coverage of 60% or greater, preferably 65% or greater, and more preferably 75% or greater.

In one embodiment, the polyalkenamer rubber composition may be used to make a solid, single core having a soft-to-hard gradient from the surface of the core to the center of the core, otherwise known as a "negative hardness gradient." In another embodiment, the polyalkenamer rubber composition may be used to make a dual-core comprising a solid inner core and solid outer core layer that surrounds the inner core. The inner core has a negative hardness gradient, while the outer core layer has a either a hard-to-soft gradient from the outer surface of the outer core layer to its inner surface, otherwise known as a "positive hardness gradient" or the outer core layer also has a negative hardness gradient.

As discussed above, the polyalkenamer rubber composition of this invention may be used in a wide variety of golf ball constructions, particularly single core and dual-core products. More particularly, in one version of the golf ball of this invention, the polyalkenamer rubber composition may be used to make a solid, single core having a negative hardness gradient. That is, the hardness of the outer surface of the core is less than the hardness of the geometric center of the core. For example, the hardness of the geometric center of the core may be 50 Shore C or greater, or 55 Shore C or greater, or 60 Shore C or greater, or 65 Shore C or greater, or 70 Shore C or greater, or 75 Shore C or greater. Meanwhile, the outer surface of the core may have a hardness of 50 Shore C or less, or 55 Shore C or less; or 60 Shore C or less; or 65 Shore C or less; or 70 Shore C or less; or 75 Shore C or less.

The single-layered core of this invention may be enclosed with one or two cover layers. In one embodiment, a multi-layered cover comprising inner and outer cover layers is formed, where the inner cover layer has a thickness of about 0.01 inches to about 0.06 inches, more preferably about 0.015 inches to about 0.040 inches, and most preferably about 0.02 inches to about 0.035 inches. In this version, the inner cover layer is formed from a partially- or fully-neutralized ionomer having a Shore D hardness of greater than about 55, more preferably greater than about 60, and most preferably greater than about 65. The outer cover layer, in this embodiment, preferably has a thickness of about 0.015 inches to about 0.055 inches, more preferably about 0.02 inches to about 0.04 inches, and most preferably about 0.025 inches to about 0.035 inches, with a hardness of about Shore D 60 or less, more preferably 55 or less, and most preferably about 52 or less. The inner cover layer is harder than the outer cover layer in this version.

A preferred outer cover layer is a castable or reaction injection molded polyurethane; polyurea; or copolymer or hybrid thereof having a Shore D hardness of about 40 to about 50. A preferred inner cover layer material is a partially-neutralized ionomer comprising zinc, sodium or lithium neutralized ionomer such as SURLYN 8940, 8945, 9910, 7930, 7940, or blend thereof having a Shore D hardness of about 63 to about 68. In another multi-layer cover, single core embodiment, the outer cover and inner cover layer materials and thickness are the same but, the hardness range is reversed, that is, the outer cover layer is harder than the inner cover layer.

As discussed above, ionomer-based compositions, particularly olefin-based ionomers, are known to be useful as a golf ball cover material, particularly as an inner cover layer, because they can impart desirable hardness to the ball. Olefin-based ionomers are acid copolymers that normally include α-olefin, such as ethylene and an α,β-ethylenically unsaturated carboxylic acid having 3 to 8 carbons, such as methacrylic acid or acrylic acid. Other possible carboxylic acid groups include, for example, crotonic, maleic, fumaric, and itaconic acid. The acid copolymers may optionally contain a softening monomer such as alkyl acrylate and alkyl methacrylate, wherein the alkyl groups have from 1 to 8 a carbon atoms. "Low acid" and "high acid" olefin-based ionomers, as well as blends of such ionomers, may be used. In general, low acid ionomers are considered to be those containing 16 wt. % or less of carboxylic acid, whereas high acid ionomers are considered to be those containing greater than 16 wt. % of carboxylic acid. The acidic group in the olefin-based ionic copolymer is partially or totally neutralized with metal ions such as zinc, sodium, lithium, magnesium, potassium, calcium, manganese, nickel, chromium, copper, or a combination thereof. For example, ionomeric resins having carboxylic acid groups that are neutralized from about 10 percent to about 100 percent may be used. In one embodiment, the acid groups are partially neutralized. That is, the neutralization level is from 10 to 80%, more preferably 20 to 70%, and most preferably 30 to 50%. In another embodiment, the acid groups are highly or fully neutralized. That is, the neutralization level is from 80 to 100%, more preferably 90 to 100%, and most preferably 95 to 100%.

In another version, the polyalkenamer rubber composition may be used to may a dual-core comprising a solid inner core and solid outer core layer that surrounds the inner core. In one preferred version, the polyalkenamer rubber composition is used to make an inner core having a zero or negative hardness gradient as described above. And, the outer core layer, which surrounds the inner core, may have an outer surface hardness substantially the same or less than its inner surface hardness to define a zero or negative hardness gradient as well. The outer core layer may be made of the polyalkenamer rubber composition or a traditional rubber composition used for golf ball cores such as, for example, polybutadiene, as described above. In still another version, the inner core may have a negative hardness gradient as described above and the hardness gradient from outer surface of the outer core layer to the inner surface of the outer core layer also may be positive.

When a dual-layered core is used, the inner core (center) preferably has a geometric center hardness of 50 Shore C or greater, or 55 Shore C or greater, or 60 Shore C or greater, or within a range having a lower limit of 50 or 55 or 60 Shore C and an upper limit of 65 or 70 or 80 Shore C. The inner core preferably has a surface hardness of 65 Shore C or greater, or 70 Shore C or greater, or within a range having a lower limit of 55 or 60 or 65 or 70 Shore C or 75 Shore C and an upper limit of 80 or 85 Shore C. Meanwhile, the outer core layer preferably has a surface hardness of 75 Shore C or greater, or 80 Shore C or greater, or 85 Shore C or greater, or 87 Shore C or greater, or 89 Shore C or greater, or 90 Shore C or greater, or within a range having a lower limit of 75 or 80 or 85 Shore C and an upper limit of 90 or 95 Shore C. And, the inner surface of the outer core preferably has a surface hardness of 65 Shore C or greater, or 70 Shore C or greater, or within a range having a lower limit of 55 or 60 or 65 or 70 Shore C or 75 Shore C and an upper limit of 80 or 85 Shore C.

Figure 4:
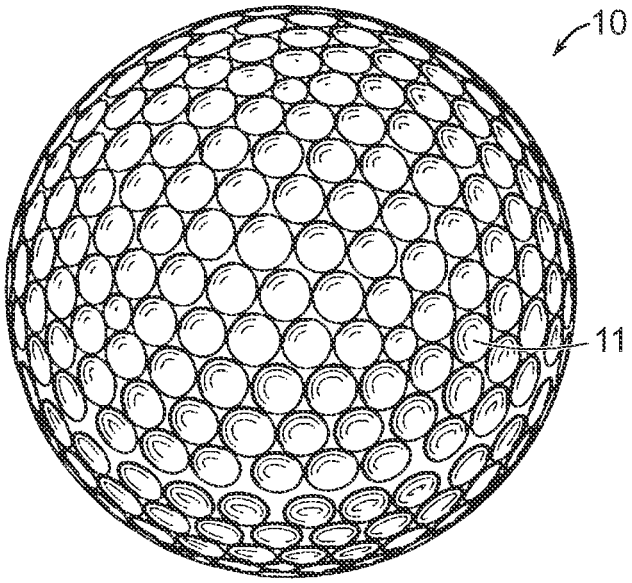
FIG. 4 is a front view of a dimpled golf ball made in accordance with the present invention.
Figure 5:
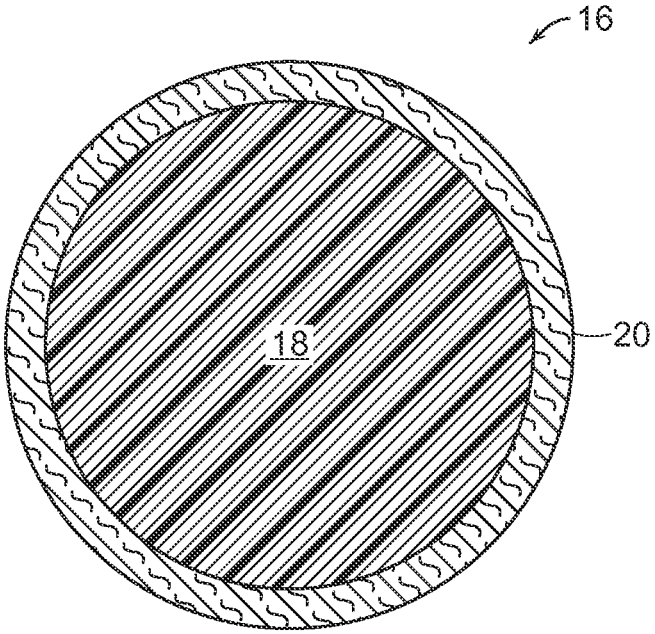
FIG. 5 is a cross-sectional view of a two-piece golf ball having an inner core made of a polyalkenamer rubber composition and a cover layer made in accordance with the present invention.
Figure 6:
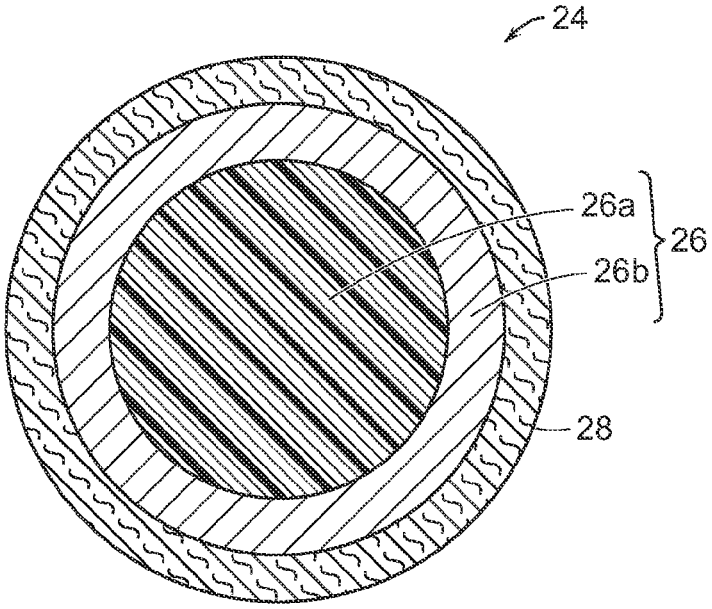
FIG. 6 is a cross-sectional view of a three-piece golf ball having a dual-core comprising an inner core and outer core made of polyalkenamer rubber compositions and a cover layer made in accordance with the present invention.
Figure 7:
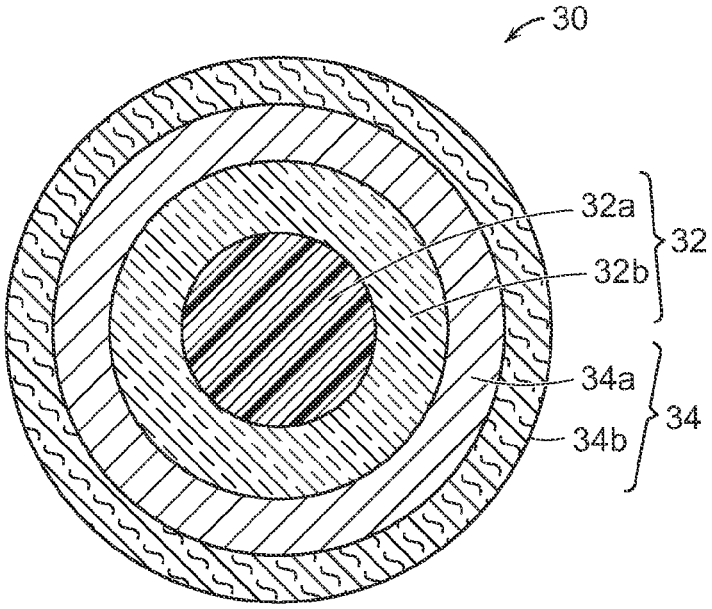
FIG. 7 is a cross-sectional view of a four-piece golf ball having a dual-core comprising an inner core and outer core made of polyalkenamer rubber compositions; and an inner cover layer and outer cover layer made in accordance with the present invention.
Figure 8:
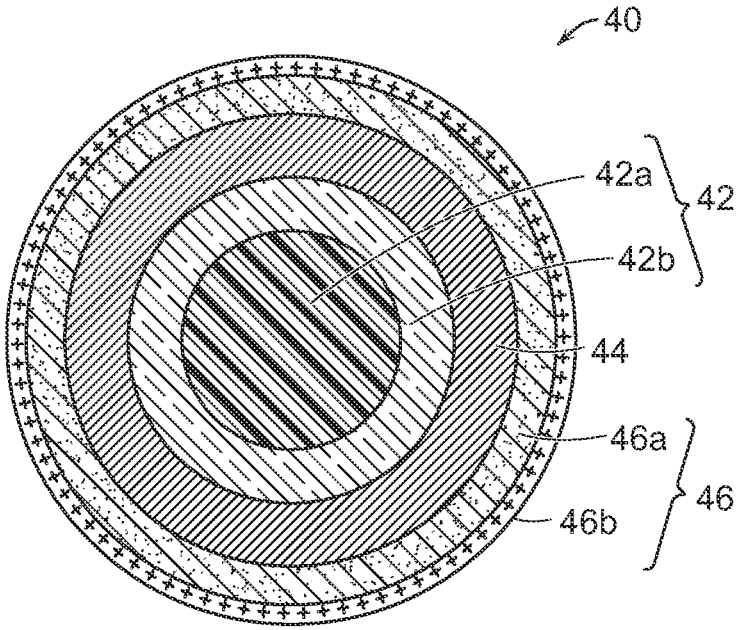
FIG. 8 is a cross-sectional view of a five-piece golf ball having a dual-core comprising an inner core and outer core made of polyalkenamer rubber compositions; an intermediate layer; and an inner cover layer and outer cover layer made in accordance with the present invention.

As discussed above, the polyalkenamer rubber materials of this invention may be used with any type of ball construction known in the art. Such golf ball designs include, for example, two-piece, three-piece, four-piece, and five-piece designs. The core, intermediate casing, and cover material can be single or multi-layered. Referring to FIG. 4, one version of a golf ball that can be made in accordance with this invention is generally indicated at (10). Various patterns and geometric shapes of dimples (11) can be used to modify the aerodynamic properties of the golf ball (10). The dimples (11) can be arranged on the surface of the ball (10) using any suitable method known in the art. Referring to FIG. 5, a two-piece golf ball (16) that can be made in accordance with this invention is illustrated. In this version, the ball (16) includes a solid, single inner core (18) and polyurethane cover (20). In FIG. 6, a three-piece golf ball (24) having a dual-core (26) comprising an inner core (26*a*) and outer core layer (26*b*) and polyurethane cover (28) is shown. In another embodiment, as shown in FIG. 7, the four-piece golf ball (30) contains a dual-core (32) comprising an inner core (32*a*) and outer core layer (32*b*). The golf ball (30) further includes a multi-layer cover (34) comprising inner cover (34*a*) and outer cover (34*b*) layers. Conventional thermoplastic or thermoset resins such as olefin-based ionomeric copolymers, polyamides, polyesters, polycarbonates, polyolefins, polyurethanes, and polyureas as described above can be used to make the inner and outer cover layers. Turning to FIG. 8 in yet another version, a five-piece golf ball (40) containing a dual-core (42) comprising an inner core (42*a*) and outer core layer (42*b*) can be made. This ball includes an intermediate layer (44) and a multi-layered cover (46) comprising an inner cover layer (46*a*) and outer cover layer (46*b*). As used herein, the term, "intermediate layer" means a layer of the ball disposed between the core and cover. The intermediate layer may be considered an outer core layer or inner cover layer or any other layer disposed between the inner core and outer cover of the ball. The intermediate layer also may be referred to as a casing or mantle layer. The intermediate layer may be made of any suitable material known in the art including thermoplastic and thermosetting materials, particularly ionomeric or non-ionomeric materials.

In one version, the intermediate layer comprises highly-neutralized polymers and blends thereof ("HNP"). The acid moieties of the HNP'S, typically ethylene-based ionomers, are preferably neutralized greater than about 70%, more preferably greater than about 90%, and most preferably at least about 100%. The HNP's can be also be blended with a second polymer component, which, if containing an acid group, may be neutralized in a conventional manner. The second polymer component, which may be partially or fully neutralized, preferably comprises ionomeric copolymers and terpolymers, ionomer precursors, thermoplastics, polyamides, polycarbonates, polyesters, polyurethanes, polyureas, thermoplastic elastomers, polybutadiene rubber, balata, metallocene-catalyzed polymers (grafted and non-grafted), single-site polymers, high-crystalline acid polymers, cationic ionomers, and the like. HNP polymers typically have a material hardness of between about 20 and about 80 Shore D.

In all preferred embodiments of invention, the hardness of the inner core at the surface is at most about the same as or substantially less than the hardness of the inner core at the center. Furthermore, the center hardness of the core may not be the hardest point in the core, but in all cases, it is preferred that it is at least equal to or harder than the surface. Additionally, the lowest hardness anywhere in the core does not have to occur at the surface. In some embodiments, the lowest hardness value occurs within about the outer 6 mm of the core surface. However, the lowest hardness value within the core can occur at any point from the surface, up to, but not including the center, as long as the surface hardness is still equal to, or less than the hardness of the center. It should be noted that in the present invention the formulation is the same throughout the core, or core layer, and no surface treatment is applied to the core to obtain the preferred surface hardness.

While the inventive golf ball may be formed from a variety of differing and conventional cover materials (both intermediate layer(s) and outer cover layer), preferred cover materials include, but are not limited to:

(1) Polyurethanes, such as those prepared from polyols or polyamines and diisocyanates or polyisocyanates and/or their prepolymers, and those disclosed in U.S. Pat. Nos. 5,334,673 and 6,506,851;

(2) Polyureas, such as those disclosed in U.S. Pat. Nos. 5,484,870 and 6,835,794; and (3) Polyurethane-urea hybrids, blends or copolymers comprising urethane or urea segments such as those disclosed in U.S. Pat. Nos. 6,476,176; 6,958,379; 6,960,630; 6,964,621; 7,041,769; 7,105,623; 7,131,915; and 7,186,777.

Suitable polyurethane compositions comprise a reaction product of at least one polyisocyanate and at least one curing agent. The curing agent can include, for example, one or more polyamines, one or more polyols, or a combination thereof. The polyisocyanate can be combined with one or more polyols to form a prepolymer, which is then combined with the at least one curing agent. Thus, the polyols described herein are suitable for use in one or both components of the polyurethane material, i.e., as part of a prepolymer and in the curing agent. Basically, polyurethane compositions contain urethane linkages formed by reacting an isocyanate group (—N═C═O) with a hydroxyl group (OH). Polyurethanes are produced by the reaction of a multi-functional isocyanate with a polyol in the presence of a catalyst and other additives. The chain length of the polyurethane prepolymer is extended by reacting it with a hydroxyl-terminated curing agent. Polyurea compositions, which are distinct from the above-described polyurethanes, also can be formed. In general, polyurea compositions contain urea linkages formed by reacting an isocyanate group (—N═C═O) with an amine group (NH or $NH_2$). The chain length of the polyurea prepolymer is extended by reacting the prepolymer with an amine curing agent. Hybrid compositions containing urethane and urea linkages also may be produced. For example, a polyurethane/urea hybrid composition may be produced when a polyurethane prepolymer is reacted with an amine-terminated curing agent. The term, "hybrid polyurethane-polyureas" is also meant to encompass blends and copolymers of polyurethanes and polyureas.

Cover layers of the inventive golf ball may also be formed from ionomeric polymers, preferably highly-neutralized ionomers (HNP). In a preferred embodiment, at least one intermediate layer of the golf ball is formed from an HNP material or a blend of HNP materials. The acid moieties of the HNP's, typically ethylene-based ionomers, are preferably neutralized greater than about 70%, more preferably greater than about 90%, and most preferably at least about 100%. The HNP's can be also be blended with a second polymer component, which, if containing an acid group, may be neutralized in a conventional manner, by the organic fatty acids of the present invention, or both. The second polymer component, which may be partially or fully neutralized, preferably comprises ionomeric copolymers and terpolymers, ionomer precursors, thermoplastics, polyamides, polycarbonates, polyesters, polyurethanes, polyureas, thermoplastic elastomers, polybutadiene rubber, balata, metallocene-catalyzed polymers (grafted and non-grafted), single-site polymers, high-crystalline acid polymers, cationic ionomers, and the like. HNP polymers typically have a material hardness of between about 20 and about 80 Shore D, and a flexural modulus of between about 3,000 psi and about 200,000 psi.

In one embodiment of the present invention the HNP's are ionomers and/or their acid precursors that are preferably neutralized, either fully or partially, with organic acid copolymers or the salts thereof. The acid copolymers are preferably α-olefin, such as ethylene, $C_{3-8}$ α,β-ethylenically unsaturated carboxylic acid, such as acrylic and methacrylic acid, copolymers. They may optionally contain a softening monomer, such as alkyl acrylate and alkyl methacrylate, wherein the alkyl groups have from 1 to 8 carbon atoms.

The acid copolymers can be described as E/X/Y copolymers where E is ethylene, X is an α,β-ethylenically unsaturated carboxylic acid, and Y is a softening comonomer. In a preferred embodiment, X is acrylic or methacrylic acid and Y is a $C_{1-8}$ alkyl acrylate or methacrylate ester. X is preferably present in an amount from about 1 to about 35 weight percent of the polymer, more preferably from about 5 to about 30 weight percent of the polymer, and most preferably from about 10 to about 20 weight percent of the polymer. Y is preferably present in an amount from about 0 to about 50 weight percent of the polymer, more preferably from about 5 to about 25 weight percent of the polymer, and most preferably from about 10 to about 20 weight percent of the polymer. Specific acid-containing ethylene copolymers include, but are not limited to, ethylene/acrylic acid/n-butyl acrylate, ethylene/methacrylic acid/n-butyl acrylate, ethylene/methacrylic acid/iso-butyl acrylate, ethylene/acrylic acid/iso-butyl acrylate, ethylene/methacrylic acid/n-butyl methacrylate, ethylene/acrylic acid/methyl methacrylate, ethylene/acrylic acid/methyl acrylate, ethylene/methacrylic acid/methyl acrylate, ethylene/methacrylic acid/methyl methacrylate, and ethylene/acrylic acid/n-butyl methacrylate. Preferred acid-containing ethylene copolymers include, ethylene/methacrylic acid/n-butyl acrylate, ethylene/acrylic acid/n-butyl acrylate, ethylene/methacrylic acid/methyl acrylate, ethylene/acrylic acid/ethyl acrylate, ethylene/methacrylic acid/ethyl acrylate, and ethylene/acrylic acid/methyl acrylate copolymers. The most preferred acid-containing ethylene copolymers are, ethylene/(meth)acrylic acid/n-butyl, acrylate, ethylene/(meth) acrylic acid/ethyl acrylate, and ethylene/(meth)acrylic acid/methyl acrylate copolymers.

Ionomers are typically neutralized with a metal cation, such as Li, Na, Mg, K, Ca, or Zn. It has been found that by adding sufficient organic acid or salt of organic acid, along with a suitable base, to the acid copolymer or ionomer, however, the ionomer can be neutralized, without losing processability, to a level much greater than for a metal cation. Preferably, the acid moieties are neutralized greater than about 80%, preferably from 90-100%, most preferably 100% without losing processability. This accomplished by melt-blending an ethylene α,β-ethylenically unsaturated carboxylic acid copolymer, for example, with an organic acid or a salt of organic acid, and adding a sufficient amount of a cation source to increase the level of neutralization of all the acid moieties (including those in the acid copolymer and in the organic acid) to greater than 90%, (preferably greater than 100%).

In a preferred embodiment, the inventive single-layer core is enclosed with two cover layers, where the inner cover layer has a thickness of about 0.01 inches to about 0.06 inches, more preferably about 0.015 inches to about 0.040 inches, and most preferably about 0.02 inches to about 0.035 inches, and the inner cover layer is formed from a partially- or fully-neutralized ionomer having a Shore D hardness of greater than about 55, more preferably greater than about 60, and most preferably greater than about 65. In this embodiment, the outer cover layer should have a thickness of about 0.015 inches to about 0.055 inches, more preferably about 0.02 inches to about 0.04 inches, and most preferably about 0.025 inches to about 0.035 inches, and has a hardness of about Shore D 60 or less, more preferably 55 or less, and most preferably about 52 or less. The inner cover layer should be harder than the outer cover layer. In this embodiment the outer cover layer comprises a partially- or fully-neutralized ionomer, a polyurethane, polyurea, or blend thereof. A most preferred outer cover layer is a castable or reaction injection molded polyurethane; polyurea; or glend, copolymer or hybrid thereof having a Shore D hardness of about 40 to about 50. A most preferred inner cover layer material is a partially-neutralized ionomer comprising a zinc, sodium or lithium neutralized ionomer such as SURLYN® 8940, 8945, 9910, 7930, 7940, or blend thereof having a Shore D hardness of about 63 to about 68.

In another multi-layer cover, single core embodiment, the outer cover and inner cover layer materials and thickness are the same but, the hardness range is reversed, that is, the outer cover layer is harder than the inner cover layer. In an alternative preferred embodiment, the golf ball is a one-piece golf ball having a dimpled surface and having a surface hardness equal to or less than the center hardness (i.e., a negative hardness gradient). The one-piece ball preferably has a diameter of about 1.680 inches to about 1.690 inches, a weight of about 1.620 oz, an Atti compression of from about 40 to 120, and a COR of about 0.750 to 0.825.

In a preferred two-piece ball embodiment, the single-layer core having a negative hardness gradient is enclosed with a single layer of cover material having a Shore D hardness of from about 20 to about 80, more preferably about 40 to about 75 and most preferably about 45 to about 70, and comprises a thermoplastic or thermosetting polyurethane, polyurea, polyamide, polyester, polyester elastomer, polyether-amide or polyester-amide, partially or fully neutralized ionomer, polyolefin such as polyethylene, polypropylene, polyethylene copolymers such as ethylene-butyl acrylate or ethylene-methyl acrylate, poly(ethylene methacrylic acid) co- and ter-polymers, metallocene-catalyzed polyolefins and polar-group functionalized polyolefins and blends thereof. A preferred cover material in the two-piece embodiment is an ionomer (either conventional or HNP) having a hardness of about 50 to about 70 Shore D. Another preferred cover material in the two-piece embodiment is a thermoplastic or thermosetting polyurethane or polyurea. A preferred ionomer is a high acid ionomer comprising a copolymer of ethylene and methacrylic or acrylic acid and having an acid content of at least 16 to about 25 weight percent. In this case the reduced spin contributed by the relatively rigid high acid ionomer may be offset to some extent by the spin-increasing negative gradient core. The core may have a diameter of about 1.0 inch to about 1.64 inches, preferably about 1.30 inches to about 1.620, and more preferably about 1.40 inches to about 1.60 inches.

Another preferred cover material comprises a castable or reaction injection moldable polyurethane; polyurea; or blend, copolymer or hybrid of polyurethane/polyurea. Preferably, this cover is thermosetting but may be a thermoplastic, having a Shore D hardness of about 20 to about 70, more preferably about 30 to about 65 and most preferably about 35 to about 60. A moisture vapor barrier layer, such as disclosed in U.S. Pat. Nos. 6,632,147; 6,932,720; 7,004,854; and 7,182,702, all of which are incorporated by reference herein in their entirety, are optionally employed between the cover layer and the core.

While any of the embodiments herein may have any known dimple number and pattern, a preferred number of dimples is 252 to 456, and more preferably is 330 to 392. The dimples may comprise any width, depth, and edge angle disclosed in the prior art and the patterns may comprises multitudes of dimples having different widths, depths and edge angles. The parting line configuration of said pattern may be either a straight line or a staggered wave parting line (SWPL). Most preferably the dimple number is 330, 332, or 392 and comprises 5 to 7 dimples sizes and the parting line is a SWPL. In any of these embodiments the single-layer core may be replaced with a 2 or more layer core wherein at least one core layer has a negative hardness gradient.

Test Methods

Hardness.

The center hardness of a core is obtained according to the following procedure. The core is gently pressed into a hemispherical holder having an internal diameter approximately slightly smaller than the diameter of the core, such that the core is held in place in the hemispherical portion of the holder while concurrently leaving the geometric central plane of the core exposed. The core is secured in the holder by friction, such that it will not move during the cutting and grinding steps, but the friction is not so excessive that distortion of the natural shape of the core would result. The core is secured such that the parting line of the core is roughly parallel to the top of the holder. The diameter of the core is measured 90 degrees to this orientation prior to securing. A measurement is also made from the bottom of the holder to the top of the core to provide a reference point for future calculations. A rough cut is made slightly above the exposed geometric center of the core using a band saw or other appropriate cutting tool, making sure that the core does not move in the holder during this step. The remainder of the core, still in the holder, is secured to the base plate of a surface grinding machine. The exposed 'rough' surface is ground to a smooth, flat surface, revealing the geometric center of the core, which can be verified by measuring the height from the bottom of the holder to the exposed surface of the core, making sure that exactly half of the original height of the core, as measured above, has been removed to within 0.004 inches. Leaving the core in the holder, the center of the core is found with a center square and carefully marked and the hardness is measured at the center mark according to ASTM D-2240. Additional hardness measurements at any distance from the center of the core can then be made by drawing a line radially outward from the center mark, and measuring the hardness at any given distance along the line, typically in 2 mm increments from the center. The hardness at a particular distance from the center should be measured along at least two, preferably four, radial arms located 180° apart, or 90° apart, respectively, and then averaged. All hardness measurements performed on a plane passing through the geometric center are performed while the core is still in the holder and without having disturbed its orientation, such that the test surface is constantly parallel to the bottom of the holder, and thus also parallel to the properly aligned foot of the durometer.

The outer surface hardness of a golf ball layer is measured on the actual outer surface of the layer and is obtained from the average of a number of measurements taken from opposing hemispheres, taking care to avoid making measurements on the parting line of the core or on surface defects, such as holes or protrusions. Hardness measurements are made pursuant to ASTM D-2240 "Indentation Hardness of Rubber and Plastic by Means of a Durometer." Because of the curved surface, care must be taken to ensure that the golf ball or golf ball subassembly is centered under the durometer indentor before a surface hardness reading is obtained. A calibrated, digital durometer, capable of reading to 0.1 hardness units is used for the hardness measurements. The digital durometer must be attached to, and its foot made parallel to, the base of an automatic stand. The weight on the durometer and attack rate conform to ASTM D-2240.

In certain embodiments, a point or plurality of points measured along the "positive" or "negative" gradients may be above or below a line fit through the gradient and its outermost and innermost hardness values. In an alternative preferred embodiment, the hardest point along a particular steep "positive" or "negative" gradient may be higher than the value at the innermost portion of the inner core (the geometric center) or outer core layer (the inner surface)—as long as the outermost point (i.e., the outer surface of the inner core) is greater than (for "positive") or lower than (for "negative") the innermost point (i.e., the geometric center of the inner core or the inner surface of the outer core layer), such that the "positive" and "negative" gradients remain intact.

As discussed above, the direction of the hardness gradient of a golf ball layer is defined by the difference in hardness measurements taken at the outer and inner surfaces of a particular layer. The center hardness of an inner core and hardness of the outer surface of an inner core in a single-core ball or outer core layer are readily determined according to the test procedures provided above. The outer surface of the inner core layer (or other optional intermediate core layers) in a dual-core ball are also readily determined according to the procedures given herein for measuring the outer surface hardness of a golf ball layer, if the measurement is made prior to surrounding the layer with an additional core layer. Once an additional core layer surrounds a layer of interest, the hardness of the inner and outer surfaces of any inner or intermediate layers can be difficult to determine. Therefore, for purposes of the present invention, when the hardness of the inner or outer surface of a core layer is needed after the inner layer has been surrounded with another core layer, the test procedure described above for measuring a point located 1 mm from an interface is used.

Also, it should be understood that there is a fundamental difference between "material hardness" and "hardness as measured directly on a golf ball." For purposes of the present invention, material hardness is measured according to ASTM D2240 and generally involves measuring the hardness of a flat "slab" or "button" formed of the material. Surface hardness as measured directly on a golf ball (or other spherical surface) typically results in a different hardness value. The difference in "surface hardness" and "material hardness" values is due to several factors including, but not limited to, ball construction (that is, core type, number of cores and/or cover layers, and the like); ball (or sphere) diameter; and the material composition of adjacent layers. It also should be understood that the two measurement techniques are not linearly related and, therefore, one hardness value cannot easily be correlated to the other. Shore C hardness was measured according to the test methods D-2240.

Compression.

As disclosed in Jeff Dalton's Compression by Any Other Name, Science and Golf IV, Proceedings of the World Scientific Congress of Golf (Eric Thain ed., Routledge, 2002) ("J. Dalton"), several different methods can be used to measure compression, including Atti compression, Riehle compression, load/deflection measurements at a variety of fixed loads and offsets, and effective modulus. For purposes of the present invention, "compression" refers to Atti compression and is measured according to a known procedure, using an Atti compression test device, wherein a piston is used to compress a ball against a spring. The travel of the piston is fixed and the deflection of the spring is measured. The measurement of the deflection of the spring does not begin with its contact with the ball; rather, there is an offset of approximately the first 1.25 mm (0.05 inches) of the spring's deflection. Very low stiffness cores will not cause the spring to deflect by more than 1.25 mm and therefore have a zero compression measurement. The Atti compression tester is designed to measure objects having a diameter of 42.7 mm (1.68 inches); thus, smaller objects, such as golf ball cores, must be shimmed to a total height of 42.7 mm to obtain an accurate reading. Conversion from Atti compression to Riehle (cores), Riehle (balls), 100 kg deflection, 130-10 kg deflection or effective modulus can be carried out according to the formulas given in J. Dalton.

Coefficient of Restitutuion ("COR").

The COR is determined according to a known procedure, wherein a golf ball or golf ball subassembly (for example, a golf ball core) is fired from an air cannon at two given velocities and a velocity of 125 ft/s is used for the calculations. Ballistic light screens are located between the air cannon and steel plate at a fixed distance to measure ball velocity. As the ball travels toward the steel plate, it activates each light screen and the ball's time period at each light screen is measured. This provides an incoming transit time period which is inversely proportional to the ball's incoming velocity. The ball makes impact with the steel plate and rebounds so it passes again through the light screens. As the rebounding ball activates each light screen, the ball's time period at each screen is measured. This provides an outgoing transit time period which is inversely proportional to the ball's outgoing velocity. The COR is then calculates as the ratio of the ball's outgoing transit time period to the ball's incoming transit time period ($COR=V_{out}/V_{in}=T_{in}/T_{out}$).

EXAMPLES

It should be understood that the examples set forth herein are for illustrative purposes only and should not be construed as limiting the scope of the invention.

A number of cores were formed based on the formulation and cure cycle described in Table 1 below and core hardness values are reported in Table 2 below and plotted in FIG. 1.

TABLE 1

| | Ex 1 | Ex 2 | Ex 3 | Comp Ex 1 | Comp Ex 2 | Comp Ex 3 |
|---|---|---|---|---|---|---|
| Formulation (phr) | | | | | | |
| SR-526+ | 34.0 | 34.0 | 31.2 | 29.0 | 29.0 | 29.0 |
| ZnO | 5 | 5 | 5 | 5 | 5 | 5 |
| $BaSO_4$ | 11.2 | 11.2 | 16.1 | 13.8 | 13.8 | 13.8 |
| VANOX MBPC* | 0.40 | 0.40 | 0.40 | — | 0.50 | — |
| TRIGONOX-265-50B** | 1.4 | 1.4 | 1.6 | — | — | 0.8 |
| PERKADOX BC-FF*** | — | — | — | 1.0 | 1.6 | — |
| Polybutadiene | 100 | 100 | 100 | 100 | 100 | 100 |
| ZnPCTP | 2.35 | 2.35 | 2.60 | 2.35 | 2.35 | 2.35 |
| Regrind | — | — | 17 | 17 | — | — |
| antioxidant/initiator ratio | 0.57 | 0.57 | 0.50 | — | 0.31 | — |
| Cure Temp. (° F.) | 305 | 315 | 320 | 350 | 335 | 335 |
| Cure Time (min) | 14 | 11 | 16 | 11 | 11 | 11 |
| Properties | | | | | | |
| diameter (in) | 1.530 | 1.530 | 1.530 | 1.530 | 1.530 | 1.530 |
| Atti compression | 69 | 63 | 70 | 69 | 47 | — |
| COR @ 125 ft/s | 0.808 | 0.806 | 0.804 | 0.804 | — | — |

*Vanox MBPC: 2,2'-methylene-bis-(4-methyl-6-t-butylphenol) available from R. T. Vanderbilt Company Inc.;
**Trigonox 265-50B: a mixture of 1,1-di(t-butylperoxy)-3,3,5-trimethycyclohexane and di(2-t-butylperoxyisopropyl) benzene 50% active on an inert carrier available from Akzo Nobel;
***Perkadox BC-FF: Dicumyl peroxide (99%-100% active) available from Akzo Nobel; and + SR-526: ZDA available from Sartomer

TABLE 2

| | Shore C Hardness | | | | | |
|---|---|---|---|---|---|---|
| Distance from Center | Ex 1 | Ex 2 | Ex 3 | Comp Ex 1 | Comp Ex 2 | Comp Ex 3 |
| Center | 73 | 70 | 71 | 61 | 52 | 61 |
| 2 | 74 | 71 | 72 | 67 | 57 | 62 |
| 4 | 74 | 72 | 73 | 70 | 62 | 65 |
| 6 | 75 | 73 | 73 | 72 | 64 | 67 |
| 8 | 75 | 73 | 73 | 73 | 64 | 69 |
| 10 | 75 | 73 | 74 | 73 | 64 | 71 |
| 12 | 74 | 74 | 73 | 72 | 66 | 72 |
| 14 | 74 | 74 | 72 | 73 | 70 | 73 |
| 16 | 70 | 71 | 70 | 77 | 71 | 73 |
| 18 | 60 | 60 | 63 | 80 | 72 | 73 |
| Surface | 63 | 70 | 66 | 85 | 73 | 74 |
| Surface − Center | −10 | 0 | −5 | 24 | 21 | 13 |

Methods of measuring hardness of the layers in the golf ball are described in the Test Methods above. Referring to Tables 1-2, in Example 1, the surface is 10 Shore C points lower than the center hardness and 12 Shore C points lower than the hardest point in the core. In Example 3, the surface is 5 Shore C points lower than the center hardness and 8 Shore C points lower than the hardest point in the core. In Example 2, the center and surface hardness values are equal and the softest point in the core is 10 Shore C points lower than the surface.

In the examples of the invention presented in Table 1, the cure temperatures are varied from 305° F. to 320° F. and cure times are varied from 11 to 16 minutes. The core compositions of Examples 1 and 2 are identical, and only the cure cycle is changed. In Example 3 the amount of antioxidant is identical to Examples 1 and 2, but other ingredients are varied as well the cure cycle. Additionally, the ratio of antioxidant to initiator varies from 0.50 to 0.57 from Examples 1 and 2 to Example 3. The ratio of antioxidant to initiator is one factor to control the surface hardness of the cores. The data shown in Table 2 shows that hardness gradient is at least, but not limited to, a function of the amount of antioxidant and peroxide, their ratio, and the cure cycle. It should be noted that higher antioxidant also requires higher peroxide initiator to maintain the desired compression.

In FIG. 1, cores of Comparative Examples 1-3 are compared to the inventive cores. The core of Comparative Example 1, whose composition is shown in Table 1 was cured using a conventional cure cycle, with a cure temperature of 350° F. and a cure time of 11 minutes. The inventive cores were produced using cure cycles of 305° F. for 14 minutes, 315° F. for 11 minutes and 320° F. for 16 minutes. The hardness gradients of these cores were measured and the following observations can be made. For the cores of the Comparative Examples, as expected, a conventional hard surface to soft center gradient can be clearly seen. The gradients for inventive cores follow substantially the same shape as one another.

Example 4

In this Example, a slug of a rubber composition having the formulation described in Table 3 was cured at about 330° F. for about 11 minutes to make a solid, single-layered core. The resulting core had a center hardness of about 68 Shore C and a surface hardness of about 70 Shore C providing a zero hardness gradient. In addition, the core had a compression of about 70 and a COR of about 0.775 @125 f/s (1.550 inch diameter solid sphere). When the core was cured at about 350° F. for about 11 minutes, the compression increased to about 90 and the COR increased to about 0.790 @125 f/s (1.550 inch diameter solid sphere).

TABLE 3

| Core Composition | Concentration (parts per hundred) |
|---|---|
| Vestenamer ® 8012 - polyoctenamer rubber available from Evonik Degussa GmbH. | 100 |
| Zinc diacrylate (ZDA) co-agent | 50 |
| Zinc oxide (ZnO) filler | 6 |
| Trigonox 145 free-radical initiator* peroxide free-radical initiator available from Akzo Nobel. | 1.5 |
| Zinc pentachlorothiophenol (ZnPCTP) | 1 |

As shown in Example 4, a single layer core made of a polyoctenamer rubber composition and having an outer surface and geometric center, wherein the hardness of the outer surface is substantially the same as the hardness of the geometric center (surface to center Shore C hardness gradient of about 2 points) can be formulated in accordance with this invention. The resulting core has good resiliency. Furthermore, Example 4 shows that a zero hardness gradient can be achieved using a polyoctenamer rubber composition that does not contain an antioxidant.

Example 5

In this Example, slugs of different polyalkenamer rubber compositions having the formulations described in Table 4 were cured at different temperature/time cycles as described in Table 5 to make solid, single-layered core samples. Concentrations are in parts per hundred (phr) unless otherwise indicated. As used herein, the term "parts per hundred," also known as "phr," is defined as the number of parts by weight of a particular component present in a mixture, relative to 100 parts by weight of the base rubber component. Mathematically, this can be expressed as the weight of an ingredient divided by the total weight of the polymer, multiplied by a factor of 100.

TABLE 4

(Core Compositions Containing 100% Polyalkenamer as Base Rubber)

| Sample | Base Rubber | ZDA Co-agent (phr) | Peroxide Free-Radical Initiator (phr) | Zinc Oxide Filler (phr) | Soft and Fast Agent (phr) |
|---|---|---|---|---|---|
| A | Vestenamer* 8012 | 0 | 0 | 0 | 0 |
| B | Vestenamer 8012 | 0 | 2.50 parts Varox* 231-XL | 0 | 0 |
| C | Vestenamer 8012 | 0 | 5.00 parts Varox 231-XL | 0 | 0 |
| D | Vestenamer 8012 | 33.5 parts SR-526* | 0.85 parts Perkadox* BC | 19.9 parts ZnO* | 0 |
| E | Vestenamer 8012 | 33.5 parts SR-526 | 1.75 parts Perkadox BC | 19.9 parts ZnO | 0 |
| F | Vestenamer 8012 | 33.5 parts SR-526 | 3.00 parts Perkadox BC | 19.9 parts ZnO | 0 |
| G | Vestenamer 8012 | 33.5 parts SR-526 | 5.00 parts Perkadox BC | 19.9 parts ZnO | 0 |
| H | Vestenamer 8012 | 33.5 parts SR-526 | 5.00 parts Perkadox BC | 19.9 parts ZnO | 1.0 parts ZnPCTP* |
| I | Vestenamer 8012 | 50 parts SR-526 | 1.00 parts Perkadox BC | 13.0 parts ZnO | 1.0 parts ZnPCTP |
| J | Vestenamer 8012 | 50 parts SR-526 | 1.00 parts Perkadox BC | 13.0 parts ZnO | 1.0 parts ZnPCTP |
| K | Vestenamer 8012 | 50 parts SR-526 | 2.00 parts Perkadox BC | 13.0 parts ZnO | 1.0 parts ZnPCTP |
| L | Vestenamer 8012 | 50 parts SR-526 | 2.00 parts Perkadox BC | 13.0 parts ZnO | 1.0 parts ZnPCTP |

TABLE 5

(CuringCycle and Properties for Core Samples)

| Sample | Cure Temp (° F.) | Cure Time (Minutes) | DCM (Compression) | COR | Shore C Hardness |
|---|---|---|---|---|---|
| A | No Heat-Curing | No Heat-Curing | 102 | 0.568 | 75 |
| B | 350° F. | 12 Min. | 47 | 0.617 | 41 |
| C | 350° F. | 12 Min. | -62 | 0.687 | — |
| D | 350° F. | 11 Min. | 60 | 0.767 | 80.4 |
| E | 350° F. | 11 Min. | 68 | 0.778 | 82.9 |
| F | 350° F. | 11 Min. | 79 | — | 85.9 |
| G | 350° F. | 11 Min. | 75 | 0.780 | 87.6 |
| H | 350° F. | 11 Min. | 56 | 0.788 | 83.8 |
| I | 330° F. | 11 Min. | 91 | 0.794 | 85.9 |
| J | 350° F. | 11 Min. | 94 | 0.795 | 89 |
| K | 330° F. | 11 Min. | 98 | 0.792 | 90.7 |
| L | 350° F. | 11 Min. | 99 | 0.796 | 90.7 |

* Vestenamer ® 8012 - polyoctenamer rubber having a trans-content of approximately 80% and a melting point of approximately 54° C., available from Evonik Degussa GmbH.
* SR-526 - zinc diacrylate available from Akzo Nobel NV.
* Varox ® 231-XL - 1,1-di(t-butylperoxy)-3,3,5-trimethylcyclohexane available from Atofina.
* Perkadox ® BC - dicumyl peroxide granules available from Akzo Nobel NV.
* ZnO—zinc oxide
* ZnPCTP - zinc pentachlorothiophenol, available from Strukol Company and Echina

Example 6

In this Example, slugs of different polyalkenamer rubber compositions having the formulations described in Table 6 were cured at different temperature/time cycles as described in Table 7 to make solid, single-layered core samples.

TABLE 6

(Core Compositions Containing Blends of Polyalkenamer and Polybutadiene Rubber)

| Sample | Base Rubber | Secondary Rubber | ZDA Co-agent (phr) | Peroxide Free-Radical Initiator (phr) | Zinc Oxide Filler (phr) | Soft and Fast Agent (phr) |
|---|---|---|---|---|---|---|
| M | 80 parts Vestenamer 8012 | 20 parts Buna CB 23 | 40 parts SR-526 | 1 part Perkadox BC | 23.5 parts ZnO | 1 part ZnPCTP |
| N | 80 parts Vestenamer 8012 | 20 parts Buna CB 23 | 40 parts SR-526 | 1 part Perkadox BC | 23.5 parts ZnO | 1 part ZnPCTP |
| O | 80 parts Vestenamer 8012 | 20 parts Buna CB 23 | 40 parts SR-526 | 3 parts Perkadox BC | 23.5 parts ZnO | 1 part ZnPCTP |
| P | 80 parts Vestenamer 8012 | 20 parts Buna CB 23 | 40 parts SR-526 | 3 parts Perkadox BC | 23.5 parts ZnO | 1 part ZnPCTP |
| Q | 80 parts Vestenamer 8012 | 20 parts Buna CB 23 | 30 parts SR-526 | 1 part Perkadox BC | 26 parts ZnO | 2 parts ZnPCTP |
| R | 80 parts Vestenamer 8012 | 20 parts Buna CB 23 | 30 parts SR-526 | 1 part Perkadox BC | 26 parts ZnO | 2 parts ZnPCTP |
| S | 80 parts Vestenamer 8012 | 20 parts Buna CB 23 | 30 parts SR-526 | 2 parts Perkadox BC | 26 parts ZnO | 2 parts ZnPCTP |
| T | 80 parts Vestenamer 8012 | 20 parts Buna CB 23 | 30 parts SR-526 | 2 parts Perkadox BC | 26 parts ZnO | 2 parts ZnPCTP |

* Buna ® CB-23 - polybutadiene rubber available from Lanxess Corp.

TABLE 7

(Curing Cycle and Properties for Core Samples)

| Sample | Cure Temp (° F.) | Cure Time (Minutes) | DCM (Compression) | COR | Shore C Hardness |
|---|---|---|---|---|---|
| M | 350° F. | 11 Min. | 89 | 0.789 | 51.4 |
| N | 330° F. | 11 Min. | 89 | 0.788 | 51.7 |
| O | 350° F. | 11 Min. | 99 | | 58.9 |
| P | 330° F. | 11 Min. | 96 | | 58.6 |
| Q | 350° F. | 11 Min. | 51 | 0.778 | 43.2 |
| R | 330° F. | 15 Min. | 54 | 0.780 | 44.5 |
| S | 350° F. | 11 Min. | 57 | 0.780 | 46.9 |
| T | 330° F. | 15 Min. | 59 | 0.780 | 48.6 |

In above Tables 4 and 5, the sample cores are made of rubber compositions containing 100% Vestenamer® 8012—polyoctenamer rubber (Samples A-L), while in Tables 6 and 7, the sample cores (M-T) are made of rubber compositions containing 80% Vestenamer 8012 and 20% Buna CB 23-polybutadiene rubber (Samples M-T).

In each of the samples, when the peroxide free-radical initiator is added to the rubber composition and heat and pressure are applied, a complex curing reaction occurs. In general, the resulting cross-linked core compositions have higher COR values. Cores with higher COR values have higher rebound velocities. These high COR cores (and golf balls made with such cores) generally rebound faster, retain more total energy when struck with a club, and have longer flight distance. The relatively high resiliency of the core means that it will reach a higher velocity when struck by a golf club and travel longer distances.

Surprisingly, however, the compression of the polyalkenamer rubber core composition in the above inventive samples does not increase substantially as the COR increases, as would be expected with conventional polybutadiene rubber cores. Rather, the compression of the polyalkenamer rubber core remains substantially the same or is reduced as the COR increases. While not wishing to be bound by any theory, it is believed the high crystallinity of the polyalkenamer rubber is reduced by adding the peroxide, particularly at relatively high amounts, as shown in Samples C and H (5 phr peroxide), and curing the composition so the rubber chains are cross-linked. This may cause the compression or stiffness of the polyalkenamer rubber composition to be reduced. Adding the peroxide at these high levels and curing and cross-linking the composition may disrupt the crystallinity of polyalkenamer. The material becomes softer and more rubbery, and the compression of the core sample is reduced. The compression of the core affects the "feel" of the ball as the club face makes impact with the ball. In general, cores with relatively low compression values have a softer feel. Golf balls made with such cores tend to have better playability and the sensation of hitting such balls is generally more pleasant. Furthermore, in general, when the ball contains a relatively soft core, the resulting spin rate of the ball is relatively low. The compressive force acting on the ball is less when the cover is compressed by the club face against a relatively soft core.

Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements. Furthermore, when numerical ranges of varying scope are set forth herein, it is contemplated that any combination of these values inclusive of the recited values may be used.

While it is apparent that the illustrative embodiments of the invention disclosed herein fulfill the objective stated above, it is appreciated that numerous modifications and other embodiments may be devised by those skilled in the art. Therefore, it will be understood that the appended claims are intended to cover all such modifications and embodiments, which would come within the spirit and scope of the present invention.

What is claimed is:

1. A golf ball, comprising:

a dual-core comprising an inner core and outer core layer, wherein the outer core layer surrounds the inner core, the inner core having a first outer surface and a geometric center, the inner core being formed from a first rubber composition, the first rubber composition comprising a cycloalkene rubber having a trans-content of 55% or greater and a melting point of 30° C. or greater in an amount of at least 50 weight percent, wherein the first outer surface and geometric center each has a hardness, the hardness of the first outer surface being the same or less than the hardness of the geometric center to define a zero or negative hardness gradient;

the outer core layer having a second outer surface and an inner surface, the outer core layer being formed from a second rubber composition, wherein the second outer surface and inner surface each has a hardness, the hardness of the second outer surface being greater than the hardness of the geometric center to define a positive hardness gradient of at least 10 Shore C units; and a cover layer surrounding the outer core layer.

2. The golf ball of claim 1, wherein the inner core layer has a zero hardness gradient.

3. The golf ball of claim 1, wherein the inner core layer has a negative hardness gradient in the range of −1 to −20 Shore C units.

4. The golf ball of claim 1, wherein the negative hardness gradient is in the range of −6 to −15 Shore C units.

5. The golf ball of claim 1, wherein the hardness of the geometric center is in the range of 50 to 84 Shore C units and the hardness of the first outer surface is in the range of 49 to 83 Shore C units.

6. The golf ball of claim 1, wherein the overall diameter of the dual-core is from 1.51 to 1.64 inches.

7. The golf ball of claim 1, wherein the hardness of the inner surface of the outer core layer is in the range of 50 to 84 Shore C units.

8. The golf ball of claim 1, wherein the hardness of the inner surface of the outer core layer is in the range of 55 to 82 Shore C units.

9. The golf ball of claim 1, wherein the hardness of the second outer surface is at least 60 Shore C units.

10. The golf ball of claim 1, wherein the hardness of the second outer surface is in the range of 65 to 95 Shore C units.

11. The golf ball of claim 1, wherein the cover layer comprises an inner cover layer and an outer cover layer.

12. A golf ball, comprising:

a dual-core comprising an inner core and outer core layer, wherein the outer core layer surrounds the inner core, the inner core having a first outer surface and a geometric center, the inner core being formed from a first rubber composition, the first rubber composition comprising a cycloalkene rubber having a trans-content of 55% or greater and a melting point of 30° C. or greater in an amount of at least 50 weight percent, wherein the first outer surface and geometric center each has a hardness, the hardness of the first outer surface being the same or less than the hardness of the geometric center to define a first zero or negative hardness gradient;

the outer core layer having a second outer surface and an inner surface, the outer core layer being formed from a second rubber composition, wherein the second outer surface and inner surface each has a hardness, the hardness of the second outer surface being in the range of 50 to 85 Shore C units and the hardness of the inner surface being in the range of 51 to 86 Shore C units, the hardness of the second outer surface being the same or less than the hardness of the inner surface to define a second zero or negative hardness gradient; and a cover layer surrounding the outer core layer.

13. The golf ball of claim 12, wherein at least one of the inner core layer and outer core layer has a negative hardness gradient in the range of −1 to −20 Shore C units.

14. The golf ball of claim 12, wherein the hardness of the second outer surface is 62 to 72 Shore C units and the hardness of the inner surface of the outer core layer is 67 to 76 Shore C units.

15. The golf ball of claim 12, wherein the cover layer comprises an inner cover layer and an outer cover layer.

* * * * *